US006615001B2

(12) United States Patent
Otomo et al.

(10) Patent No.: US 6,615,001 B2
(45) Date of Patent: Sep. 2, 2003

(54) CARTRIDGE, IMAGE FORMING APPARATUS AND METHOD OF CONTROLLING THE IMAGE FORMING APPARATUS

(75) Inventors: Yasunao Otomo, Shizuoka (JP); Takashi Hibi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/978,628

(22) Filed: Oct. 18, 2001

(65) Prior Publication Data

US 2002/0048463 A1 Apr. 25, 2002

(30) Foreign Application Priority Data

Oct. 20, 2000 (JP) ..... 2000-320934
Apr. 25, 2001 (JP) ..... 2001-128319

(51) Int. Cl.[7] ..... G03G 15/08
(52) U.S. Cl. ..... 399/27; 399/61
(58) Field of Search ..... 399/27, 61

(56) References Cited

U.S. PATENT DOCUMENTS 5,790,917 A * 8/1988 Takura et al. ..... 399/27
5,095,335 A 3/1992 Watanabe et al. ..... 355/210
5,126,800 A 6/1992 Shishido et al. ..... 355/211
5,519,418 A * 5/1996 Nishikawa et al. ..... 347/19
5,835,818 A 11/1998 Hoshika et al. ..... 399/26
6,253,044 B1 6/2001 Shoji et al. ..... 399/111

FOREIGN PATENT DOCUMENTS

JP 63-163383 * 7/1998
US 1990-155277 * 4/1990

* cited by examiner

*Primary Examiner*—Quana M. Grainger
(74) *Attorney, Agent, or Firm*—Fitzpatrick, Cella, Harper & Scinto

(57) ABSTRACT

In a developer container, there are provided a flat antenna for measuring the predetermined range of the developer-remaining-amount, and a plate antenna for measuring the predetermined amount or less of the developer-remaining-amount. When the detected value by the flat antenna is a predetermined value or greater, the minimum detected voltage value of the plate antenna is measured, and this value is stored as PAF (plate antenna full) in the storing means of a cartridge. During the measurement of the predetermined value or less of the developer by the plate antenna, the detected voltage value is calculation-processed and corrected by PAF to thereby obtain the developer amount.

32 Claims, 16 Drawing Sheets

CARTRIDGE, IMAGE FORMING APPARATUS AND METHOD OF CONTROLLING THE IMAGE FORMING APPARATUS

BACKGROUND OF THE INVENTION

1. Field of the Invention

This invention relates to an image forming apparatus using the electrophotographic process, and a process cartridge detachably mountable to the main body of the image forming apparatus or a developing device made into a cartridge, and particularly to an image forming system comprised of storing means carried on the process cartridge or the developing device, and indicating means for detecting the remaining amount of developer by the use of developer amount detecting means disposed in the process cartridge or the developing device, and indicating the result thereof.

The term "electrophotographic image forming apparatus" covers, for example, an electrophotographic copier, an electrophotographic printer (such as an LED printer or a laser beam printer), an electrophotographic facsimile apparatus, etc.

Also, the cartridge detachably mountable to the main body of the electrophotographic image forming apparatus refers to at least one of an electrophotographic photosensitive member, charging means for charging the electrophotographic photosensitive member, developing means for supplying a developer to the electrophotographic photosensitive member, and cleaning means for cleaning the electrophotographic photosensitive member constructed detachably mountably to the main body of the electrophotographic image forming apparatus. Particularly, the process cartridge refers to at least one of the charging means, the developing means and the cleaning means and the electrophotographic photosensitive member constructed integrally with each other, and made detachably mountable to the main body of the electrophotographic image forming apparatus.

2. Related Background Art

An image forming apparatus of the electrophotographic type such as a copier or a laser beam printer applies light modulated in accordance with image information to a photosensitive member to thereby form a latent image thereon, supplies a developer (toner) which is a developing material to the latent image by developing means to thereby visualize the latent image, and further transfers the image from the photosensitive member to a recording medium to thereby form an image on the recording medium. A developer container containing the developer therein is connected to the developing means, and the developer is consumed by images being formed.

In such an image forming apparatus, there is a process cartridge system in which with a view to achieve the simplicity of the interchange and maintenance of expendibles such as the electrophotographic photosensitive member and the developer, the electrophotographic photosensitive member, and developing means, charging means and cleaning means as process means for acting on the electrophotographic photosensitive member, and further a developer container, a developer reservoir or the like are made integral with one another as a process cartridge which is detachably mountable to the main body of the image forming apparatus. According to the process cartridge system, the maintenance of the apparatus can be done by the user himself without resorting to a serviceman and therefore, the operability of the apparatus can be markedly improved.

So, the process cartridge system is widely used in electrophotographic image forming apparatus.

Also, for example, among color image forming apparatuses having developing means of a plurality of colors, there is one in which when the degrees of consumption of the respective developing means differ from one another, a developing cartridge of each color into which the developing means of each color and a developer container are made is made detachably mountable to the image forming apparatus so as to be individually interchangeable.

In the image forming apparatus of such a cartridge type, the user can interchange the cartridge, for example, at a point of time whereat the developer has become exhausted, to thereby form an image again. Therefore, such an image forming apparatus is sometimes provided with means for detecting that the developer has been consumed, and informing the user of it, i.e., a developer amount detecting device.

The developer amount detecting device is provided with developer amount detecting means capable of detecting the developer-remaining-amount level in the cartridge or the main body of the image forming apparatus in order to enable how much developer usable for image formation remains in the cartridge to be known at any time.

Particularly, there are image forming apparatuses in which not only the user is informed that the developer has become exhausted, but also the amount of the developer is sequentially detected and the user is informed of it, whereby the convenience to the user is further improved. Among such image forming apparatuses, there is one in which how many percent of the amount when unused the developer remains is calculated and sequentially reported to the user or the "no developer" indication showing that the developer has been decreased to such a degree that image formation of a predetermined quality cannot be effected is done to thereby warn the user that the remaining amount of the developer has become small before a bad image occurs.

As a system of the developer amount detecting means, there is a flat antenna system. A flat antenna is a pattern provided with a pair of electrically conducting portions formed in parallel to each other at a predetermined interval, and disposed at a position on the side of a developer container which is in contact with the developer, and utilizes the fact that the capacitance is changed by the presence or absence of the developer on the surface of the pattern.

The flat antenna is disposed so that as the developer in the developer container is decreased, the area of contact between the developer and the flat antenna may decrease, whereby it becomes possible to make the remaining amount of the developer and the capacitance of the flat antenna correspond to each other, and by measuring the capacitance of the flat antenna, it is possible to know the remaining amount of the developer in the developer container at any time. The capacitance of the flat antenna can be known by a constant AC bias being applied to one of the pair of electrically conducting portions, and from an electric current flowing through the other electrically conducting portion at that time.

Actually, even if the developer in the developer container is gradually decreased, a slight amount of developer adheres to and remains on the flat antenna and in order to remove it, an antenna cleaning member is provided and the surface of the flat antenna is cleaned with the rotation of agitating means.

However, by the cleaning of the surface of the antenna, the output of the flat antenna is fluctuated at a surface cleaning cycle period. So, such statistical processing as taking the mean value in conformity with the cycle period or selecting a minimum value is carried out to thereby decide upon the developer-remaining-amount level.

Also, as another system of the developer amount detecting means, there is developer amount detecting means of the plate antenna type in a developing system wherein an AC bias is applied to a developer bearing member disposed in opposed relationship with a photosensitive member to thereby develop a latent image on the photosensitive member.

The plate antenna is constituted by a metal plate provided in parallel to the developer carrying member, and utilizes the fact that the capacitance between the plate antenna and the developer bearing member changes in conformity with the amount of non-conductive developer present between the two.

If the space between the plate antenna and the developer bearing member is filled up with the developer, the capacitance becomes greater, and as the developer is decreased, the air increases between the two and the capacitance becomes smaller. Accordingly, by predetermining the relation between the capacitance between the plate antenna and the developer bearing member and the amount of developer, to thereby measure the capacitance, the developer amount level can be detected.

The capacitance can be found by measuring an electric current flowing through the plate antenna when the AC bias is applied to the developer bearing member. That is, the developer amount detecting system detects the developer-remaining-amount level during image formation when the developer bias is applied to the developer bearing member.

The amount of developer detected by such developer amount detecting means is indicated in indicating means to inform the user of it. The user can judge by looking at the indication that the developer will soon become exhausted, so it would be better to prepare the next cartridge, or that the developer is present sufficiently for a great deal of print to be effected, and can carry out the printing work efficiently and can use the cartridge effectively.

However, even if provision is made of the developer amount detecting means capable of detecting the developer-remaining-amount level as described above, there may occur an error between the amount of developer remaining in the developer container and the detected value by the developer amount detecting means.

For example, the absolute value of the capacitance between the developer bearing member and the plate antenna is affected by the positional relation between the two in such a manner that even when the developer is absent, the aforementioned absolute value becomes greater if the distance between the two is short, and becomes smaller if the distance between the two is long. That is, when the detection of the developer-remaining-amount level is effected by a present capacitance value alone, there is the possibility of outputting a detected value widely different from the actual developer remaining amount.

Accordingly, when the detected value at the full of the developer is greater in capacitance than the initially set (supposed) value, an amount greater than the actual developer-remaining-amount is estimated and the developer may become exhausted before warning and an image having a blank area may occur. Conversely, when the detected value at the full of the developer is smaller in capacitance than the initially set (supposed) value, an amount smaller than the actual developer-remaining-amount is estimated, and in spite of a great deal of developer remaining in the developer container, the no-developer warning may be given, and if the process cartridge is interchanged in accordance with the warning, a great deal of developer will be wasted and this will be the waste of resources.

Also, when a great amount of developer fills the developer container, it will become difficult to generally effect accurate detection of the amount of developer by only one developer detecting means.

SUMMARY OF THE INVENTION

The present invention has as its object to provide an image forming apparatus in which the amount of developer can generally be successively and accurately detected and an appropriate cartridge interchange time is shown and the occurrence of bad images can be prevented and the waste of a developer and recording media can be eliminated, a cartridge detachably mountable to the image forming apparatus, and a method of controlling the image forming apparatus.

The cartridge detachably mountable to the main body of the image forming apparatus according to the present invention comprises a developer container, first developer detecting means for outputting the detection value of the developer-remaining-amount in the developer container, second developer detecting means for outputting the detection value of the developer-remaining-amount in the developer container, and storing means for storing therein information regarding the developer-remaining-amount, the storing means having an area for storing therein data regarding the developer-remaining-amount from the second developer detecting means in conformity with the result of the comparison between the detection value of the developer amount from the first developer detecting means and a predetermined value.

In a cartridge detachably mountable to the main body of another image forming apparatus according to the present invention, the storing means has an area for storing therein the detection value of the developer-remaining-amount from the second developer detecting means when the detection value of the developer-remaining-amount has become a value within a predetermined range as the result of the comparison between the detected value of the developer-remaining-amount from the first developer detecting means and a predetermined value.

In a cartridge detachably mountable to the main body of another image forming apparatus according to the present invention, the storing means has an area for storing therein a value obtained by calculation-processing a plurality of detection values of the developer-remaining-amount from the second developer detecting means when the detected value of the developer-remaining-amount has become a value within a predetermined range as the result of the comparison between the detection value of the developer-remaining-amount from the first developer detecting means and a predetermined value.

In a cartridge detachably mountable to the main body of another image forming apparatus according to the present invention, the storing means has an area for storing therein the developer-remaining-amount obtained by calculation-processing the detection value of the developer-remaining-amount from the second developer detecting means by a signal processing device in the main body of the image forming apparatus when the detection value of the developer-remaining-amount has become a value within a predetermined range as the result of the comparison between the detected value of the developer-remaining-amount from the first developer detecting means and a predetermined value.

In a cartridge detachably mountable to the main body of another image forming apparatus according to the present invention, the storing means has an area for storing therein calculation formula information obtained by calculation-processing by the use of the detection value of the developer amount from the first developer detecting means and the detection value of the developer amount from the second developer detecting means by a signal processing device in the main body of the image forming apparatus when as the result of the comparison between the detected value of the developer-remaining-amount from the first developer detecting means and a predetermined value, the detection value of the developer-remaining-amount has become equal to the predetermined value.

In a cartridge detachably mountable to the main body of another image forming apparatus according to the present invention, the storing means has an area for comparing the detection value of the developer-remaining-amount from the first developer detecting means and a predetermined value with each other, repetitively detecting the detection value of the developer-remaining-amount from the second developer detecting means until the detection value of the developer-remaining-amount becomes greater than the predetermined value, and storing therein the minimum value of the detected detection values of the developer-remaining-amount.

In an image forming apparatus according to the present invention comprising a cartridge comprising a developer container, first and second developer detecting means for outputting the detection values of the developer-remaining-amount in the developer container, and storing means for storing therein information regarding the developer-remaining-amount, and signal processing means for calculation-processing the detection value of the developer-remaining-amount, the signal processing means causes data regarding the developer-remaining-amount from the second developer detecting means to be stored in the storing means in conformity with the result of the comparison between the detection value of the developer amount from the first developer detecting means and a predetermined value, and calculates the developer-remaining-amount by the use of the stored data.

In another image forming apparatus according to the present invention, the detection value of the developer-remaining-amount from the second developer detecting means is stored in the storing means when the detection value of the developer-remaining-amount has become a value within a predetermined range as the result of the comparison between the detection value of the developer-remaining-amount from the first developer detecting means and a predetermined value, and the developer-remaining-amount is calculated by the use of the stored detection value of the developer-remaining-amount.

In another image forming apparatus according to the present invention, a plurality of detection values of the developer-remaining-amount from the second developer detecting means are calculated when the detection value of the developer-remaining-amount has become a value within a predetermined range as the result of the comparison between the detection value of the developer-remaining-amount from the first developer detecting means and a predetermined value, and the result is stored in the storing means, and the developer-remaining-amount is calculated by the use of the stored detection value of the developer-remaining-amount.

In another image forming apparatus according to the present invention, calculation formula information calculated from the developer-remaining-amount calculated from the detection value of the developer-remaining-amount from the first developer detecting means and the detection value of the developer-remaining-amount from the second developer detecting means is stored in the storing means when as the result of the comparison between the detection value of the developer-remaining-amount from the first developer detecting means and a predetermined value, the detection value of the developer-remaining-amount has become equal to the predetermined value, and the developer-remaining-amount is calculated from the detection value of the developer-remaining-amount from the second developer detecting means and the calculation formula information.

In another image forming apparatus according to the present invention, the signal processing means compares the detection value of the developer-remaining-amount from the first developer detecting means and a predetermined value, and repetitively detects the detection value of the developer-remaining-amount from the second developer detecting means until the detection value of the developer-remaining-amount becomes greater than the predetermined value, and causes the minimum value of the detected detection values of the developer-remaining-amount to be stored in the storing means, and calculates the developer-remaining-amount by the use of the minimum value of the detection values of the developer-remaining-amount stored in the storing means when the detection value of the developer-remaining-amount from the first developer detecting means has become equal to or greater than the predetermined value.

Another image forming apparatus according to the present invention further comprises indicating means, and the signal processing means transmits the calculated developer-remaining-amount to the indicating means or an external indicating instrument.

A method of controlling an image forming apparatus according to the present invention to which is detachably mountable a cartridge comprising a developer container, first and second developer detecting means for outputting the detection values of the developer-remaining-amount in the developer container, and storing means for storing therein information regarding the developer-remaining-amount, and which has signal processing means for calculation-processing the detection value of the developer-remaining-amount, comprises the step of outputting the detection value of the developer-remaining-amount by the first developer detecting means with the power source of the main body of the image forming apparatus switched on, the step of comparing the detection value of the developer-remaining-amount outputted by the first developer detecting means and a predetermined value with each other, and the step of storing in storing means data regarding the developer-remaining-amount outputted by the second developer detecting means, in conformity with the result of the comparison at the comparing step.

Another method of controlling an image forming apparatus according to the present invention comprises the step of storing in the storing means the detection value of the developer-remaining-amount outputted by the second developer detecting means when at the comparing step, the detection value of the developer-remaining-amount is a value within a predetermined range.

Another method of controlling an image forming apparatus according to the present invention comprises the step of calculating a plurality of detection values of the developer-remaining-amount outputted by the second developer detecting means by the signal processing means, and thereafter storing them in the storing means when at the comparing step, the detection value of the developer-remaining-amount is a value within a predetermined range.

Another method of controlling an image forming apparatus according to the present invention comprises the step of detecting the detection value of the developer-remaining-amount by the second developer detecting means when at the comparing step, the detection value of the developer-remaining-amount is greater than the predetermined value, and the step of calculating the developer-remaining-amount by the use of the detection value of the developer-remaining-amount read from the storing means.

Another method of controlling an image forming apparatus according to the present invention comprises the step of calculating calculation formula information from the detection value of the developer-remaining-amount outputted from the first developer detecting means and the detection value of the developer-remaining-amount outputted from the second developer detecting means when at the comparing step, the detection value of the developer-remaining-amount is the predetermined amount, and the step of calculating the developer-remaining-amount by the use of the calculation formula information.

Another method of controlling an image forming apparatus according to the present invention comprises the step of detecting the detection value of the developer-remaining-amount outputted from the second developer detecting means and storing the detection value in the storing means when at the comparing step, the detection value of the developer-remaining-amount is greater than the predetermined value, and further repetitively detecting the detection value of the developer-remaining-amount outputted from the second developer detecting means until the detection value of the developer-remaining-amount becomes a value greater than the predetermined value, and storing in the storing means the minimum value of the detected detection values of the developer-remaining-amount.

Another method of controlling an image forming apparatus according to the present invention further comprises the step of transmitting the developer-remaining-amount calculated by the use of the detection value of the developer-remaining-amount stored in the storing means to indicating means in the image forming apparatus or an external indicating instrument.

According to the present invention, there is the effect that the developer-remaining-amount can generally be detected successively and accurately, and an appropriate cartridge interchange time can be shown to the user to thereby obviate the occurrence of bad images, and eliminate the waste of the developer and the recording medium.

DESCRIPTION OF THE PREFERRED EMBODIMENTS (First Embodiment)

Figure 1:
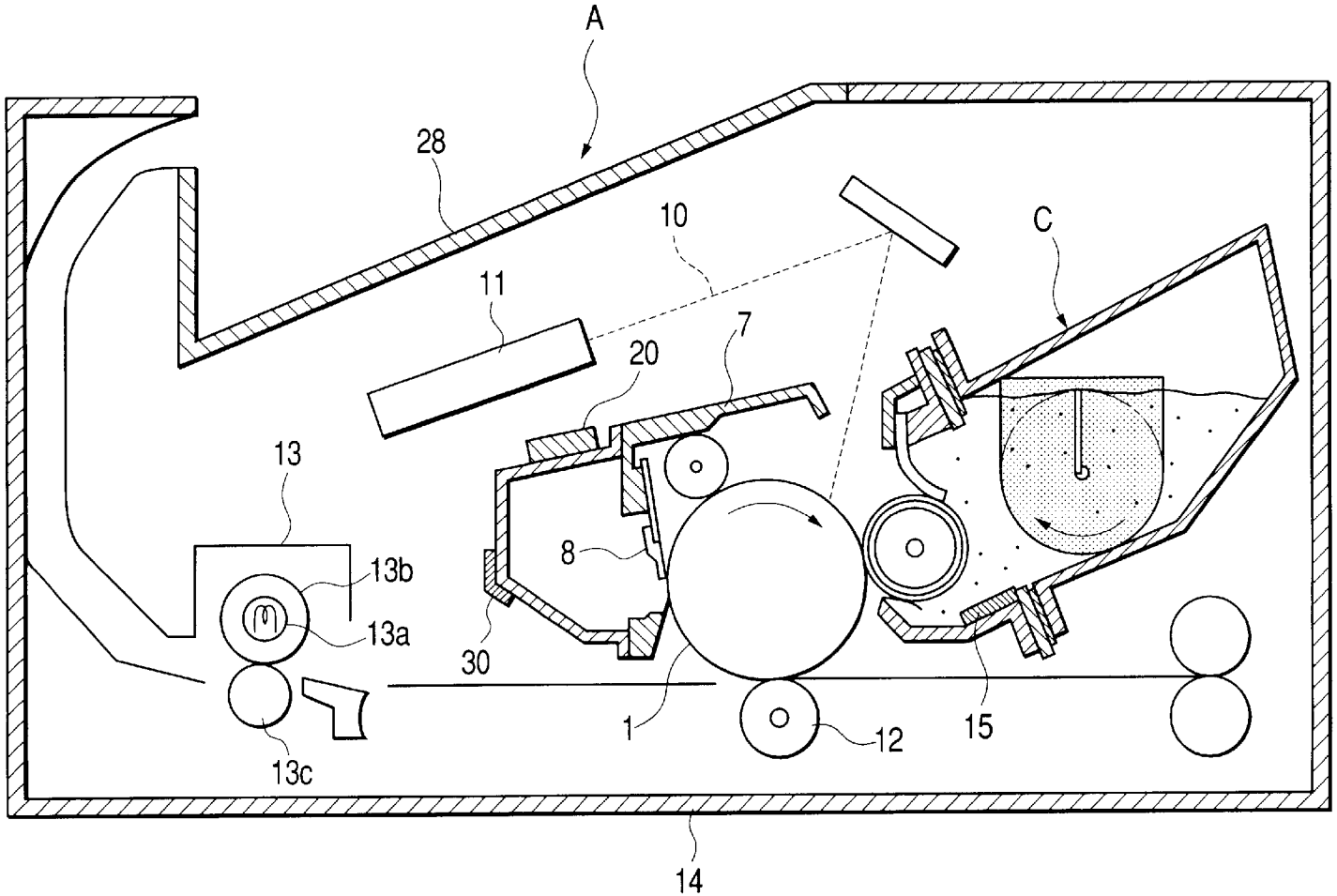
FIG. 1 is a cross-sectional view showing a process cartridge and an image forming apparatus.
Figure 2:
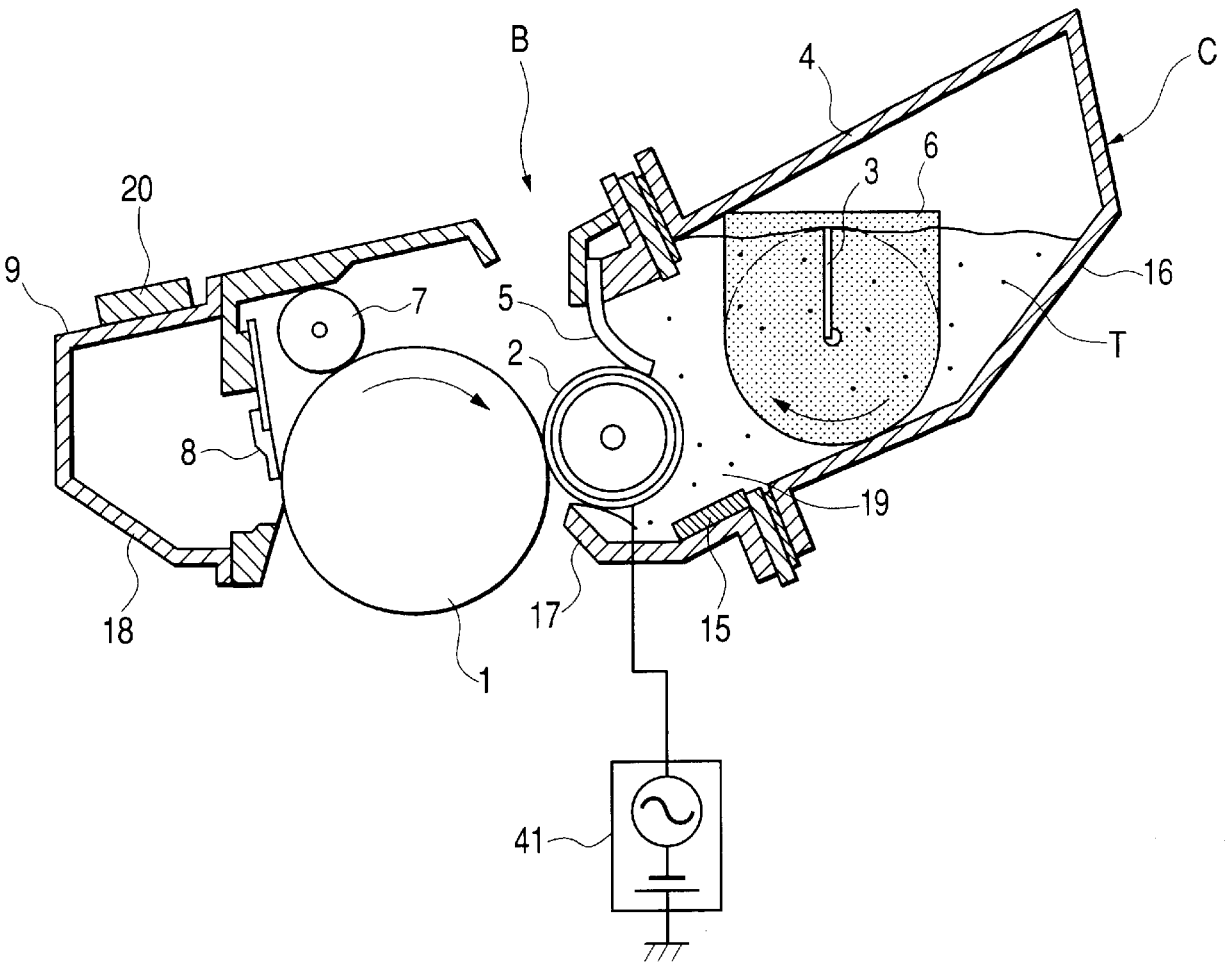
FIG. 2 is an enlarged cross-sectional view of the process cartridge of FIG. 1.
Figure 3:
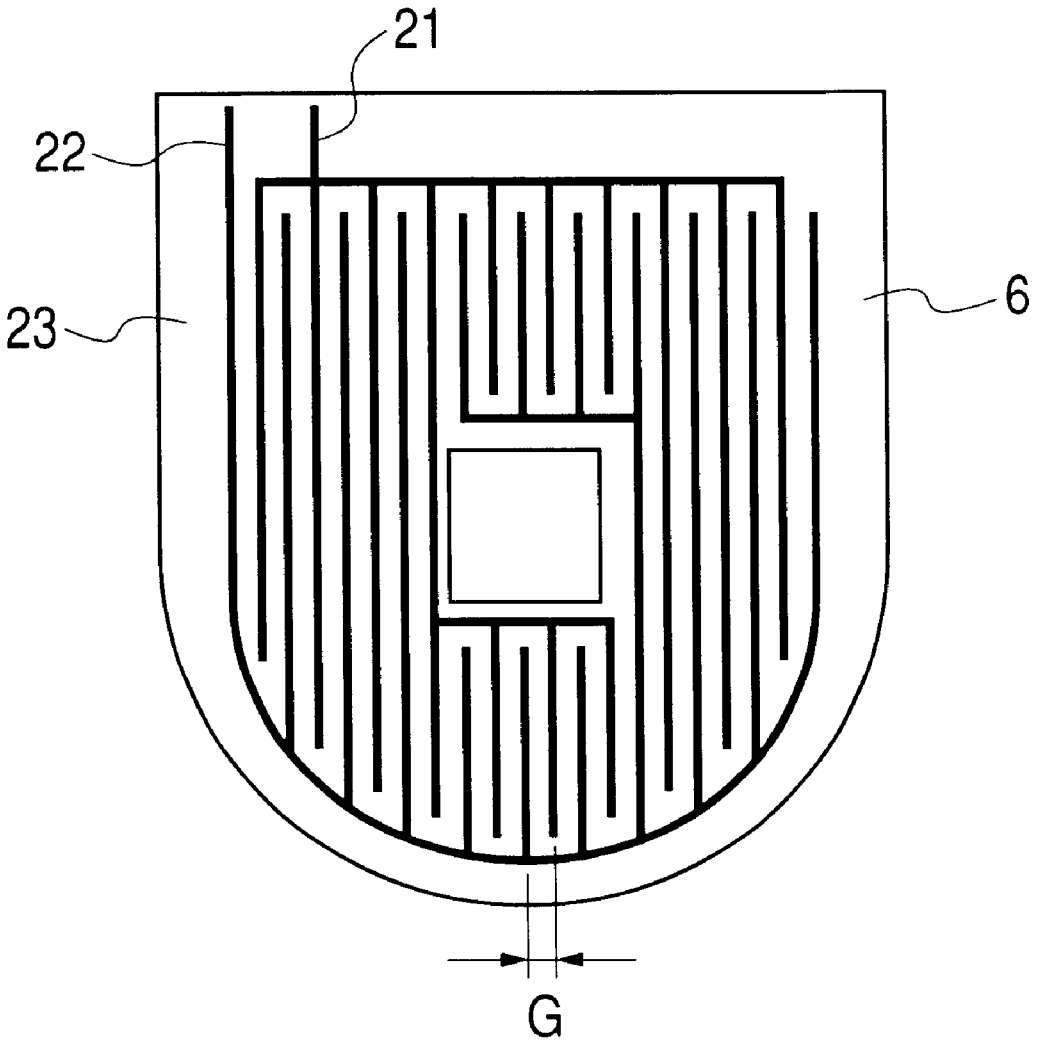
FIG. 3 shows developer amount detecting means which can be carried on the process cartridge.

Reference is first had to FIGS. 1 to 3 to describe an embodiment of an electrophotographic image forming apparatus to which a process cartridge constructed in accordance with the present invention is detachably mountable.

In the present embodiment, the electrophotographic image forming apparatus is a laser beam printer A of the electrophotographic type, and receives information from a host computer, and forms an image on a recording medium such as recording paper, OHP sheet or cloth by the electrophotographic image forming process.

The laser beam printer A has a drum-shaped electrophotographic photosensitive member, i.e., a photosensitive drum 1. The photosensitive drum 1 is charged by a charging roller 7 which is charging means, and then a laser beam 10 conforming to image information is applied thereto from a laser scanner 11, whereby a latent image conforming to the image information is formed on the photosensitive drum 1. This latent image is developed by a developing device C and is made into a visible image, i.e., a toner image.

The developing device C has a developing chamber 19 provided with developing means such as a developing roller 2 which is a developer bearing member and a developing blade 5 which is a developer-layer-thickness regulating member, and a developer container 4 as a developer containing portion formed adjacent to the developing chamber 19, and a developer T in the developer container 4 is supplied to the developing roller 2 in the developing chamber 19. Agitating means 3 rotated in the direction indicated by the arrow in FIG. 2 is provided in the developing container 4, and by the agitating means 3 being rotated, the developer T is supplied to the developing roller 2 while being loosened.

In the present embodiment, an non-conductive magnetic mono-component toner is used as the developer. Also, the developing roller 2 contains a stationary magnet therein, and by the roller 2 being rotated, the developer T is conveyed and triboelectric charges are imparted thereto by a developing blade 5 and also, the developer is made into a layer of a predetermined thickness, and is supplied to the developing area of the photosensitive drum 1. The developer T supplied to the developing area is transferred to the latent image on the photosensitive drum 1 to thereby form a toner image.

The developing roller 2 is connected to developing bias applying means, i.e., a power source 41, and usually a developing bias voltage comprising a DC voltage superimposed upon an AC voltage is applied thereto.

On the other hand, in correspondence with the formation of the toner image, a recording medium set in a feed cassette, not shown, is transported to a transferring position through a pickup roller and transporting means. A transferring roller 12 as transferring means is disposed at the transferring position, and a voltage is applied thereto, whereby the toner image on the photosensitive drum 1 is transferred to the recording medium.

The recording medium to which the toner image has been transferred is transported to fixing means 13 by the transporting means. The fixing means 13 is provided with a fixing roller 13*b* containing a heater 13*a* therein and a driving roller 13*c*, and applies heat and pressure to the passing recording medium to thereby fix the transferred toner image on the recording medium.

The recording medium is delivered onto a delivery tray 28 by the transporting means. This delivery tray 28 is provided on the upper surface of the main body 14 of the laser beam printer.

After the toner image has been transferred to the recording medium by the transferring roller 12, the photosensitive drum 1 has any developer residual thereon removed by cleaning means and is used for the next image forming process. The cleaning means scrapes off the residual developer on the photosensitive drum 1 by an elastic cleaning blade 8 providing in abutting relationship with the photosensitive drum 1 and collects the residual developer into a developer reservoir 9.

On the other hand, in the present embodiment, as shown in FIG. 2, the process cartridge B is provided by welding a developer frame 16 having the developer container 4 and the agitating means 3 and a developing frame 17 holding developing means such as the developing roller 2 and the developing blade 5 together to thereby form a developing unit (developing device) C, and integrally coupling to the developing unit C a cleaning frame 18 on which are mounted the photosensitive drum 1, the cleaning means such as the cleaning blade 8 and the developer reservoir 9, and the charging roller 7 to thereby make them into a cartridge.

The process cartridge B is detachably mounted to cartridge mounting means 30 provided in the main body 14 of the image forming apparatus by the user.

Also, in the present embodiment, a flat antenna 6 as developer amount detecting means for measuring an area in which the developer-remaining-amount is greater is disposed on one side in the developer container 4, and a plate antenna 15 which is developer amount detecting means for measuring an area in which the developer-remaining-amount is smaller is disposed on the bottom of the developing chamber 19 in the vicinity of the developing roller 2 in parallel to the developing roller 2.

As shown in FIG. 3, the flat antenna 6 comprises two electrodes, i.e., conductor patterns 21 and 22 formed on a generally used print substrate 23 as by etching or printing. Also, in order to protect the circuit pattern, insulating protective film (not shown) is formed on the surface thereof. In the present embodiment, the interval (G) between the two electrically conductive patterns 21 and 22 of the flat antenna is set as narrowly as the order of 300 $\mu$m.

In the flat antenna 6 of the present embodiment, when an AC bias of 200 Vpp and 2000 Hz was applied to between the electrodes 21 and 22 of the respective electrically conductive patterns, different capacitance values, i.e., 20 pF and 40 pF, were observed when the developer was not in contact with the flat antenna 6 and when the developer was in contact with the entire surface of the flat antenna 6, respectively.

As the developer T in the developer container 4 is decreased by the image forming process being repeated, the area of contact between the developer T and the flat antenna 6 decreases, and in conformity therewith, the capacitance between the electrodes 21 and 22 of the flat antenna 6 also decreases. Consequently, by observing the capacitance, it is possible to know the amount of developer in the developer container 4 at any time.

On the other hand, the plate antenna 15 of the present embodiment is comprised of a metal plate disposed as described above, and may be formed of any material which permits an electric current to flow therethrough, and in the present embodiment, uses SUS strong against rust.

When an AC bias of the order of 1600 Vpp and 2 kHz and a DC bias of the order of 400 V are applied as a developing bias from a power supply 41 to the developing roller 2, an alternating current proportional to the capacitance between the developing roller 2 and the plate antenna 15 flows between the two. The capacitance between the developing roller 2 and the plate antenna 15 changes in conformity with the amount of developer between the two and therefore, by observing the electric current flowing through the plate antenna 15, it is possible to know the amount of developer in the developer container 4.

Also, storing means 20 capable of storing various kinds of information therein is carried on the process cartridge B on the developer reservoir 9 side thereof. While in the present embodiment, the storing means 20 is installed on the developer reservoir 9 side, it may be installed on the developer container 4 side.

NVRAM capable of reading and writing is adopted as the storing means 20 in the present embodiment.

Figure 4:
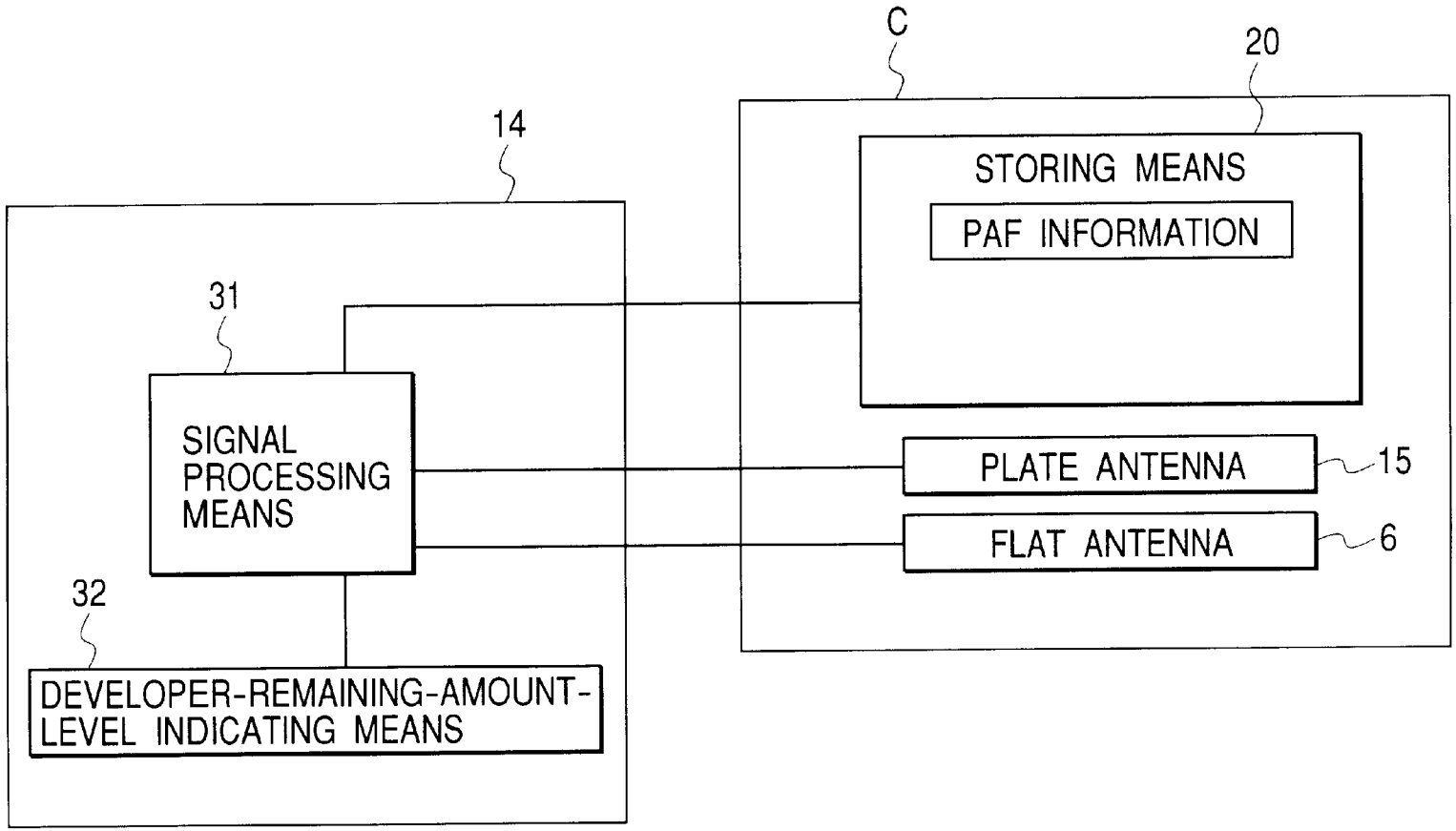
FIG. 4 is a block diagram showing the developer amount detecting construction of a first embodiment.

As shown in FIG. 4, the writing and reading of data into and from the storing means 20 are effected by signal processing means 31 provided in the main body 14 of the image forming apparatus. The signal processing means 31 also processes the output signals of the flat antenna 6 and the plate antenna 15 and decides upon the developer-remaining-amount level, and compares the value thereof and the value of the storing means 20 with each other.

Figure 5:
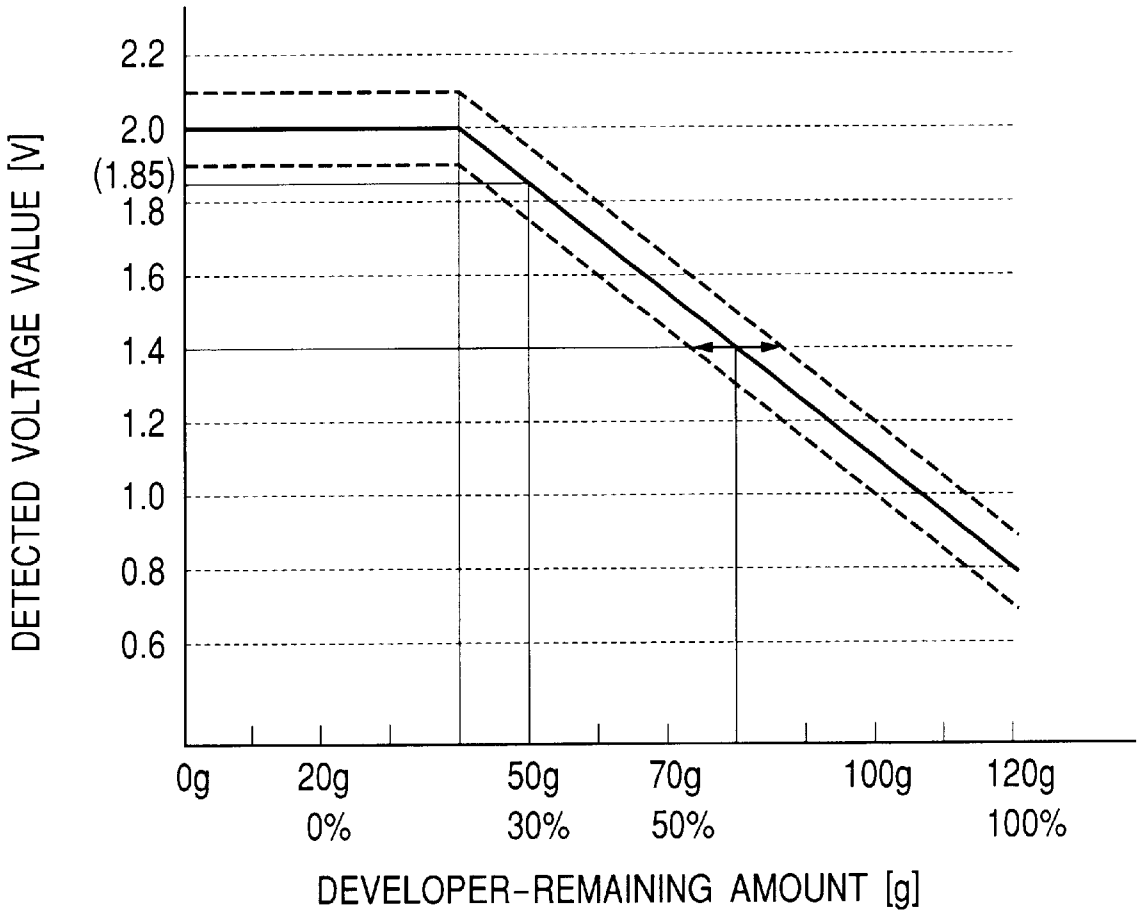
FIG. 5 is a graph showing the relation between the developer-remaining-amount and the detected voltage value of a flat antenna.

In the present embodiment, in the area wherein the developer-remaining-amount is great, the capacitance is detected by the flat antenna 6, and the output value thereof is converted into a voltage and outputted in the main body 14 of the image forming apparatus. The relation between the detected voltage value of the flat antenna 6 and the developer-remaining-amount is shown in FIG. 5.

The detected voltage is set so as to be small when the capacitance is great, and to be great when the capacitance is small. When the toner is in a full state on the flat antenna 6, the detected voltage value exhibits a minimum value (the capacitance exhibits a maximum value). When the developer-remaining-amount is between 120 g to 40 g, the area of contact of the developer with the flat antenna 6 changes and therefore, the detected voltage value changes correspondingly to the amount of developer, but when the developer-remaining-amount is less than 40 g, the developer does not come into contact with the flat antenna 6 and therefore, the detected voltage value does not change. Accordingly, the detection range of the flat antenna 6 according to the present embodiment is 120 g to 40 g.

Figure 6:
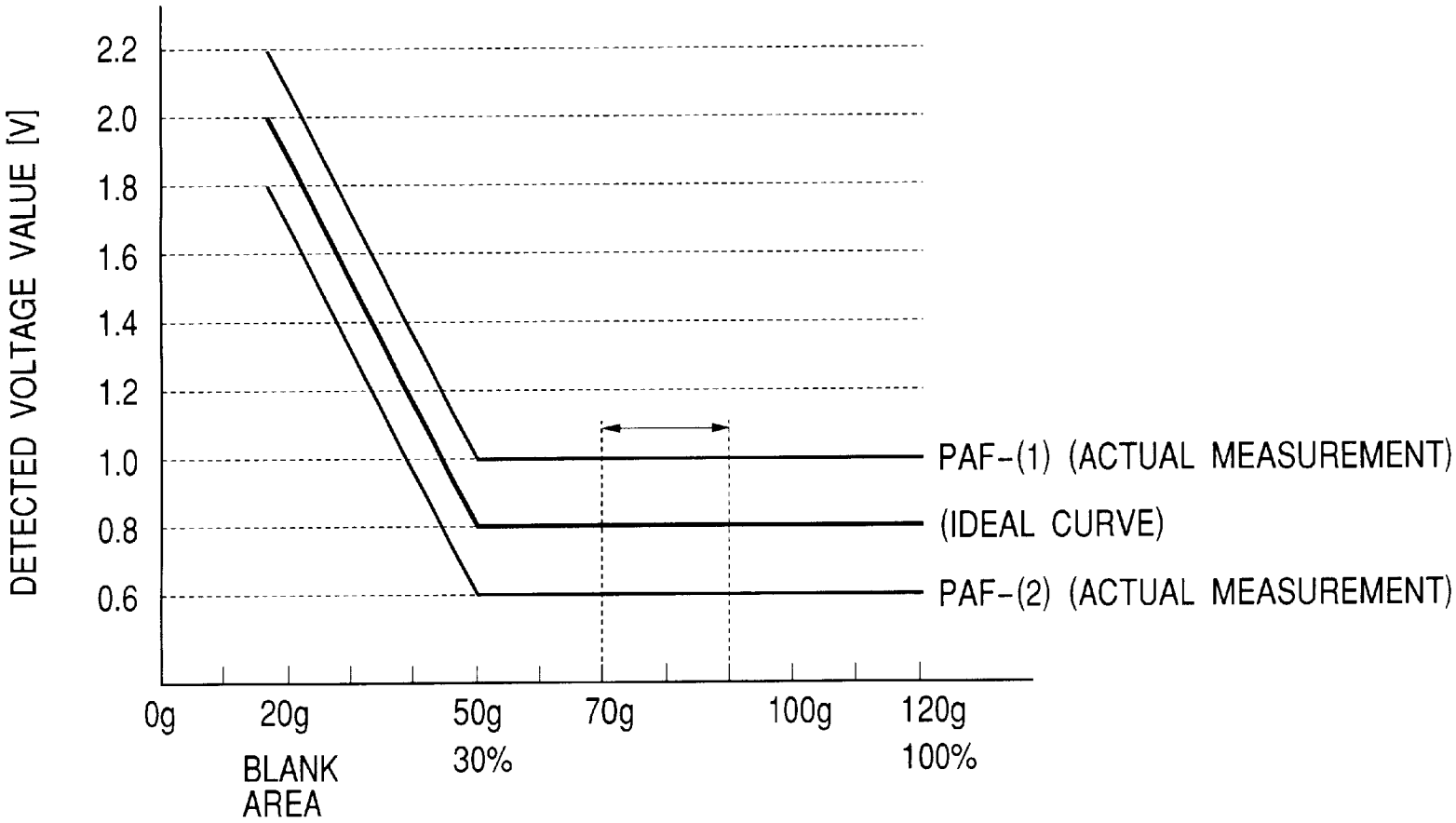
FIG. 6 is a graph showing the relation between the developer-remaining-amount and the detected voltage value of a plate antenna.

Also, in the present embodiment, besides the flat antenna 6, the plate antenna 15 is used to detect the capacitance, and the output value thereof is converted into a voltage by the main body of the image forming apparatus, and is outputted as the voltage value as shown in FIG. 6. The detected voltage is also set so as to be small when the capacitance is great, and to be great when the capacitance is small.

When the developer (toner) is in a full state between the plate antenna 15 and the developing roller 2, the detected voltage value exhibits a minimum value (the capacitance exhibits a maximum value). The detected voltage value changes correspondingly to the developer-remaining-amount, but when the developer-remaining-amount is 50 g or greater, the developer in the detection area does not change and therefore, the detected voltage value does not change. Accordingly, the detection range of the plate antenna 15 according to the present embodiment is 50 g or less.

The minimum value of the detected voltage value by the plate antenna 15 in the present embodiment will hereinafter be called PAF (the abbreviation of plate antenna full value). In FIG. 6, the axis of abscissas represents the amount of developer in the developer container 4, and the axis of ordinates represents the detected voltage value measured between the plate antenna 15 and the developing roller 2. In FIG. 6, there are written an ideal curve (thick line) when the plate antenna 15 is at the center of design, and curves (thin lines, actual measurements) when the plate antenna 15 is not at the center of design.

In any case, the inclination of the curve does not change if the amount of developer contained in the developer container 4 is the same, and if there is the positional deviation of the plate antenna 15, the detected voltage value (capacitance value) in a state in which the developer is absent differs and thus, the actual measurement relatively deviates from the curve of the center of design. Accordingly, when the indication of the developer-remaining-amount is to be effected by a value set on the basis of the center of design, such setting has been adopted that a blank area warning is given when the detected voltage value has become 2.0 V.

Also in the case of the flat antenna 6, depending on the deviation of the disposition of the electrodes and the unevenness of the location of disposition thereof, the inclination of the curve does not change if the amount of developer contained in the developer container is the same, but the actual measurement (broken line) may relatively deviate from the curve (solid line) of the center of design (see FIG. 5).

However, what is important in the detection of the developer-remaining-amount is the detection of the developer-remaining-amount in which the developer remaining-amount is smaller, and in the present embodiment, the measurement accuracy of the plate antenna 15 is more required than the measurement accuracy of the flat antenna 6.

So, the unevenness of the plate antenna will be described further. If the no-developer indication is effected at 2.0 V when the relation between the amount of developer and the detected voltage value follows the curve of PAF-(1), 5 g of developer will be left. This gives the no-developer warning to the user in spite of the developer being present and thus, the developer is thrown away wastefully.

On the other hand, if in the case of a cartridge in which the relation between the developer-remaining-amount and the detected voltage value follows the curve of PAF-(2), the no-developer indication is effected at 2.0 V, the no-developer warning is given after a state in which an image having a blank area is produced is passed and thus, an inconvenient image is printed out, and as the result, the recording medium such as paper is thrown away wastefully.

In order to prevent such waste of the developer or paper or the like, in the present embodiment, the above-mentioned PAF is determined, and this is read into as PAF information by the storing means 20, and on the basis of the stored value (hereinafter referred to as the "PAF value"), the relation between the amount of developer and the detected voltage value is determined, and on the basis of the relational expression, the amount of developer is calculation-processed and corrected, and the corrected amount of developer is indicated in developer-remaining-amount-level indicating means 32.

The determination of the above-mentioned PAF value and the developer-remaining-amount indicating sequence will hereinafter be described with reference to the flowchart of FIG. 7. The flat antenna 6 is written also as FA (flat antenna), and the plate antenna 15 is written also as PA.

Description will first be made of the sequence of the developer-remaining-amount indication by the flat antenna 6.

A main body power source is switched on (S101), and a power source for the flat antenna is switched on (S102). Next, the output of the flat antenna 6 is processed by the signal processing means 31 and the developer-remaining-amount is detected (S103), and the power source for the flat antenna is switched off (S104). Then, whether the detected value by the flat antenna 6 is 80 g or greater is judged (S105), and if it is 80 g or greater, the then detected value is indicated in the developer-remaining-amount-level indicating means (developer-remaining-amount indicating means) 32 (S107), thus terminating the sequence (S119).

If at the step S105, the detected value by the flat antenna 6 is smaller than 80 g, whether the PAF value is present in the storing means 20 is judged (S106), and if it is judged to be present, whether the detected value by the flat antenna 6 is 50 g or greater is judged (S108). If it is judged to be 50 g or greater, the detected value by the flat antenna 6 is indicated in the developer-remaining-amount-level indicating means 32 (S107), thus terminating the sequence (S119).

As described above, in the present embodiment, as long as the detected value by the flat antenna 6 is 50 g or greater (the detected voltage value is 1.85 V or less), the value detected by the flat antenna 6 is indicated as the developer-remaining-amount in the developer-remaining-amount-level indicating means 32.

The sequence of PAF value determination will now be described with reference also to FIG. 7.

The sequence of steps S101 to S105 is similar to the developer-remaining-amount indicating sequence by the flat antenna 6. Next, whether PAF information is present in the storing means 20 is judged by the signal processing means 31 (S106), and if it is judged to be absent, a power source for the plate antenna is switched on (S115), and the output of the plate antenna 15 is processed by the signal processing means 31 and the developer-remaining-amount is detected (S116), and the power source for the plate antenna is switched off (S117), whereafter the detected value (PAF) by the plate antenna 15 is written into the storing means 20 (S118), thus terminating the sequence (S119).

As described above, in the present embodiment, PAF determination is effected at 80 g or less in the flat antenna 6, i.e., at 1.4 V or greater in terms of the detected voltage value by the flat antenna 6. This is firstly because there is measurement unevenness in the flat antenna 6 as in the plate antenna 15, but even if the measurement of 1.4 V becomes uneven, the actual developer-remaining-amount is within the range of 70 g–90 g (the range indicated by the double-headed arrow in FIG. 5) and PAF is in a flat state (the range indicated by the double-headed arrow in FIG. 6) and it is possible to reliably detect PAF. This is secondly because after the process cartridge B is mounted to the main body 14 of the image forming apparatus, constant agitation is secured and the height of the developer in the developer container 4 is uniform and PAF can be detected with good accuracy.

Description will now be made of the sequence of the developer-remaining-amount detection by the plate antenna 15.

The steps S101 to S106 are similar to the sequence of the developer-remaining-amount indication by the flat antenna 6. If at a step S108, the detected value by the flat antenna 6 is judged to be smaller than 50 g, the power source for the plate antenna is switched on (S109), and the developer-remaining-amount is detected by the plate antenna 15 (S110), and the power source for the plate antenna is switched off (S111). Next, the signal processing means 31 reads PAF information from the storing means 20 (S112), and calculation-processes and corrects the developer-remaining-amount detection value by the plate antenna 15 on the basis of PAF (S113). Then, the corrected value is indicated in the developer-remaining-amount-level indicating means 32 (S114) thus terminating the sequence (S119).

Here, description will be made of the correcting method by the PAF value at the step S113.

When the detection value successively detected by the plate antenna 15 at the step S110 is defined as Z(V) and the PAF value read from the storing means 20 at the step S112 is defined as X(V), the developer-remaining-amount Y(g) after the correction is $$Y=25\times(2-Z+X) \quad (1)$$

That is, the successively detected detection value Z and X which is PAF are used in expression (1), whereby the developer-remaining-amount Y after the correction is calculated.

In expression (1), the numerical value 25 is a constant for converting the detected voltage into the developer-remaining-amount, and the numerical value 2 is the maximum detected voltage value (V) at the center of design of the flat antenna.

As will be understood from the foregoing description, the point of the present invention is not to simply indicate the developer-remaining-amount conforming to a predetermined detected voltage value, but to effect the calibration of the plate antenna by the use of the flat antenna to thereby correct the successively detected detection value by the above-described correcting method on the basis of the minimum value (PAF) of the found detected voltage value, and indicate the developer-remaining-amount and to use a plurality of developer-remaining-amount detecting means to thereby detect the developer-remaining-amount over a wide range and accurately.

The indication of the developer-remaining-amount is not restricted to being effected by the developer-remaining-amount-level indicating means provided in the main body of the image forming apparatus, but can also be effected by display means such as the screen of an apparatus such as a host computer connected to the main body 14 of the image forming apparatus for communication therewith.

Although not shown, the developer-remaining-amount value Y after the correction calculated by the aforementioned expression (1) may be stored in the storing means 20.

(Second Embodiment)

A second embodiment of the present invention will now be described with reference to FIG. 8. The second embodiment is similar in basic construction to the first embodiment and accordingly, the different portion thereof, i.e., the sequence of PAF determination, will hereinafter be described.

At a step S206, whether the storing means 20 has PAF (MEAN) is judged, and if the storing means 20 does not have the PAF (MEAN), the PAF (MEAN) determining sequence is carried out. First, the power source for the plate antenna is switched on (S215), and the developer-remaining-amount is detected by the plate antenna 15 (S216). The power source for the plate antenna is switched off (S217), whereafter the detected value (PAF (N)) by the plate antenna 15 is written into the storing means 20 (S218). Here, PAF (N) means the Nth PAF, and in the present embodiment, up to the tenth PAF, i.e., PAF (1) to PAF (10) are written into the storing means.

Next, whether ten PAF's, i.e., PAF (1) to PAF (10) are stored is judged (S220), and if they are not stored, the steps S215 to S218 are repeated. The timing from after PAF (N) is written into the storing means until PAF (N+1) is written into the storing means is regarded as the time when the detected value by the flat antenna has risen by 0.01 V.

If at the step S220, PAF (1) to PAF (10) are judged to be stored, the ten values from PAF (1) to PAF (10) are averaged, and that value, i.e., PAF (MEAN), is written into the storing means 20 (S221), thus terminating the sequence (S219). The processing of the mean value at this time is represented by the following expression (2):

$$PAF(\mathrm{MEAN})=(\Sigma PAF(N))/N \quad (2)$$

In the present embodiment, by averaging PAF (1) to PAF (10), it becomes possible to prevent the unevenness of PAF due to the unevenness of the signal processing means 31 or the power source 41 of the main body 14 of the apparatus, and the determination of PAF can be accomplished more accurately.

Figure 7:
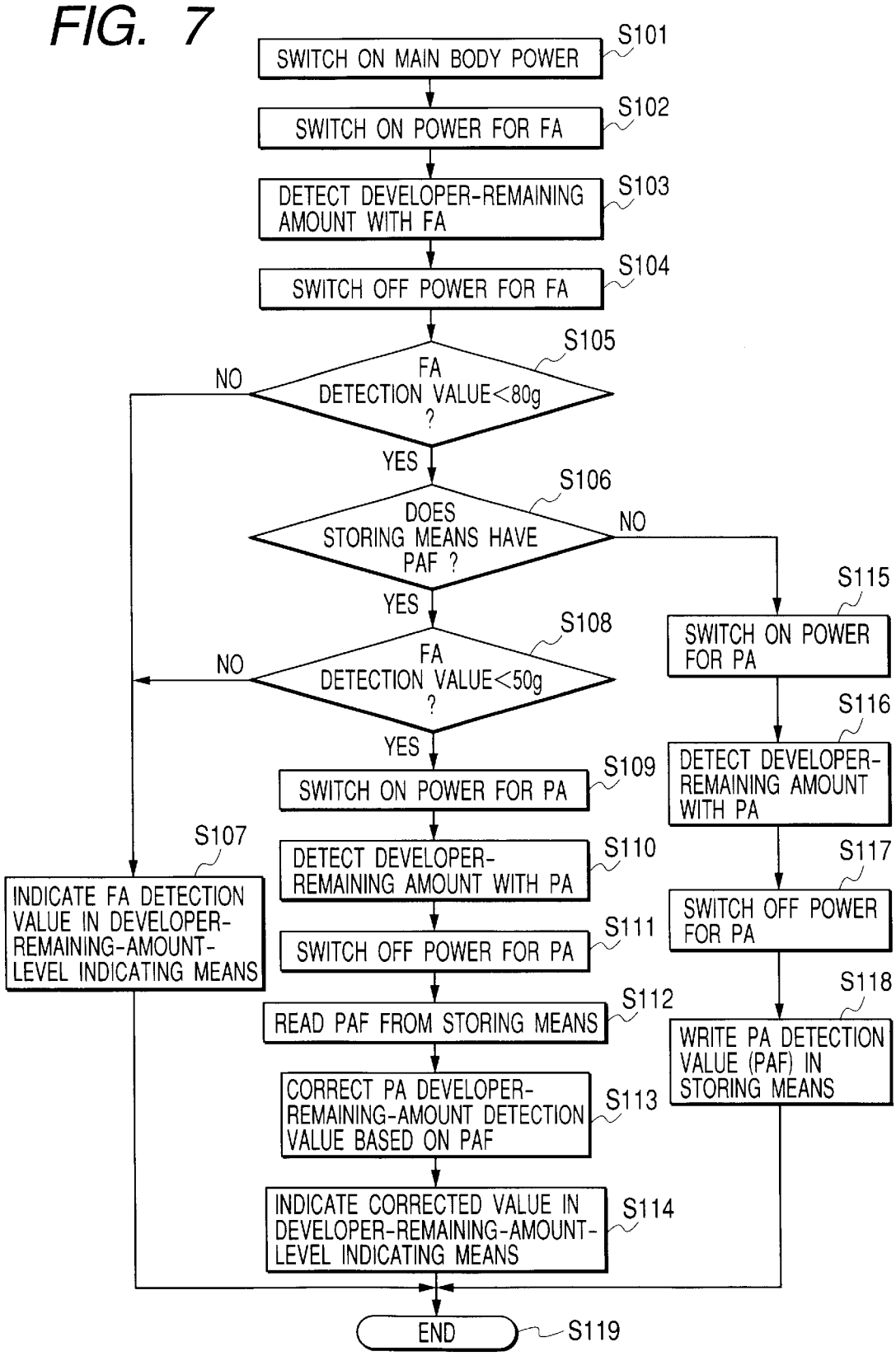
FIG. 7 is a flowchart showing the developer-remaining-amount detecting process of the first embodiment.
Figure 8:
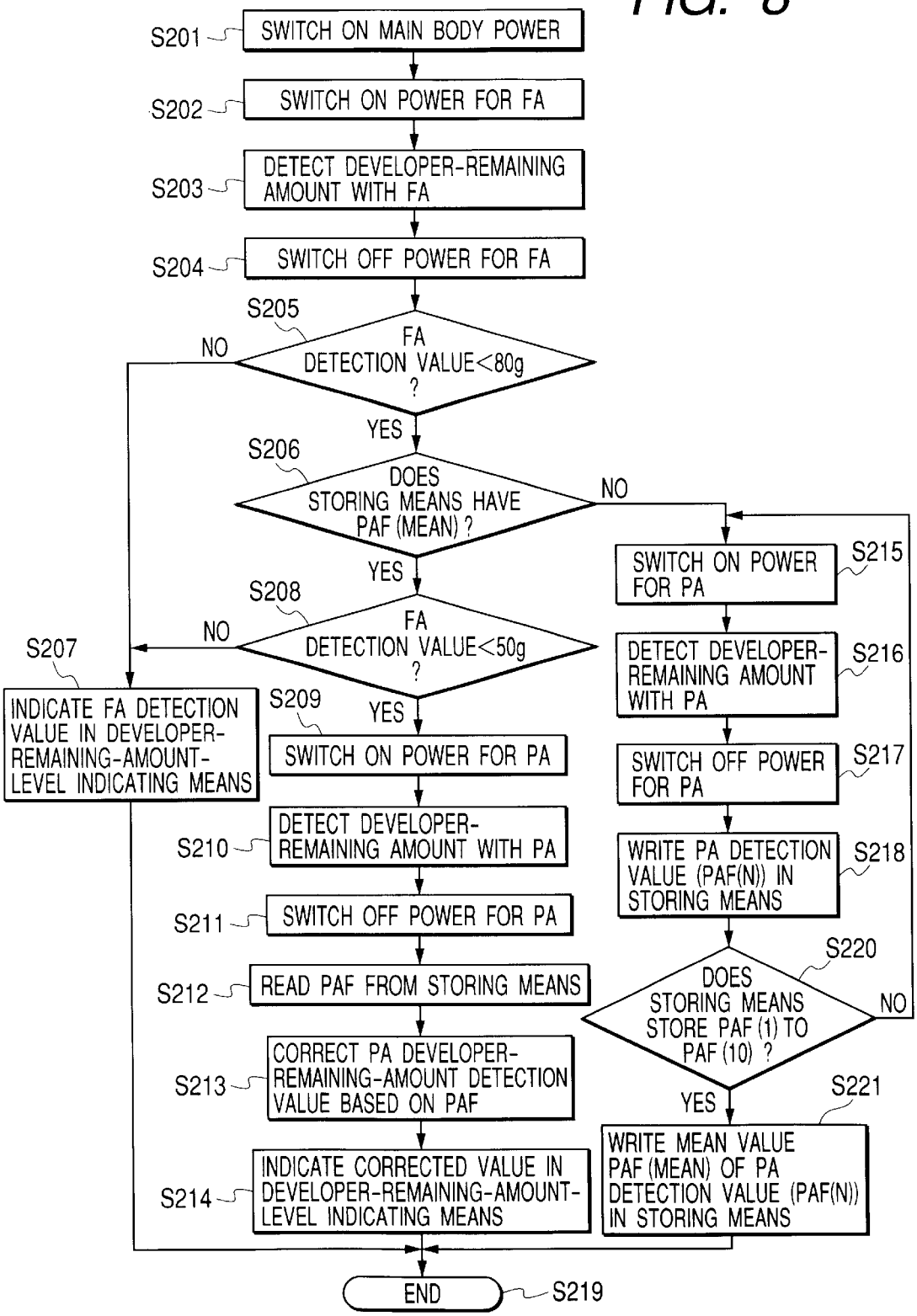
FIG. 8 is a flowchart showing the developer-remaining-amount detecting process of a second embodiment.

In the flowchart of FIG. 8, the steps S201 to S219, except the step S206 and the above-described steps S215 to S221, are the same as the steps S101 to S119 in the flowchart of FIG. 7 in the first embodiment.

(Third Embodiment)

A third embodiment of the present invention will now be described with reference to FIGS. 9 to 12. The third embodiment is similar in basic construction to the first embodiment and accordingly, only the different portions thereof will hereinafter be described.

In the first embodiment and the second embodiment, description has been made of the correcting method when in the relation between the developer-remaining-amount and the detected voltage value by the plate antenna 15, the inclination is constant and the intercept has changed.

In the present embodiment, description will be made of the correcting method when in the above-mentioned relation, not only the intercept but also the inclination have changed.

Figure 9:
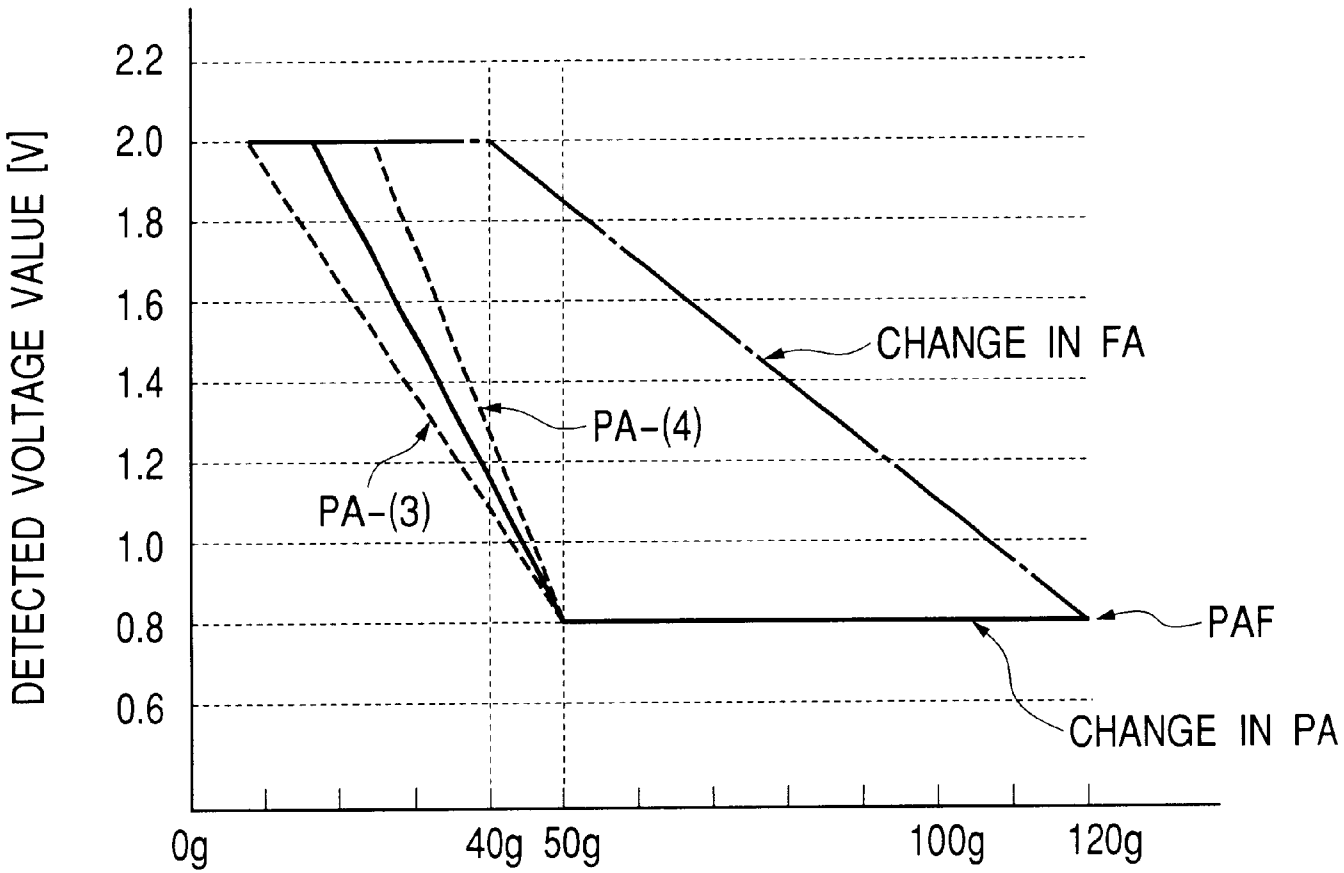
FIG. 9 is a graph showing the relation between the developer-remaining-amount and the detected voltage values of the flat antenna and the plate antenna in a third embodiment.
Figure 10:
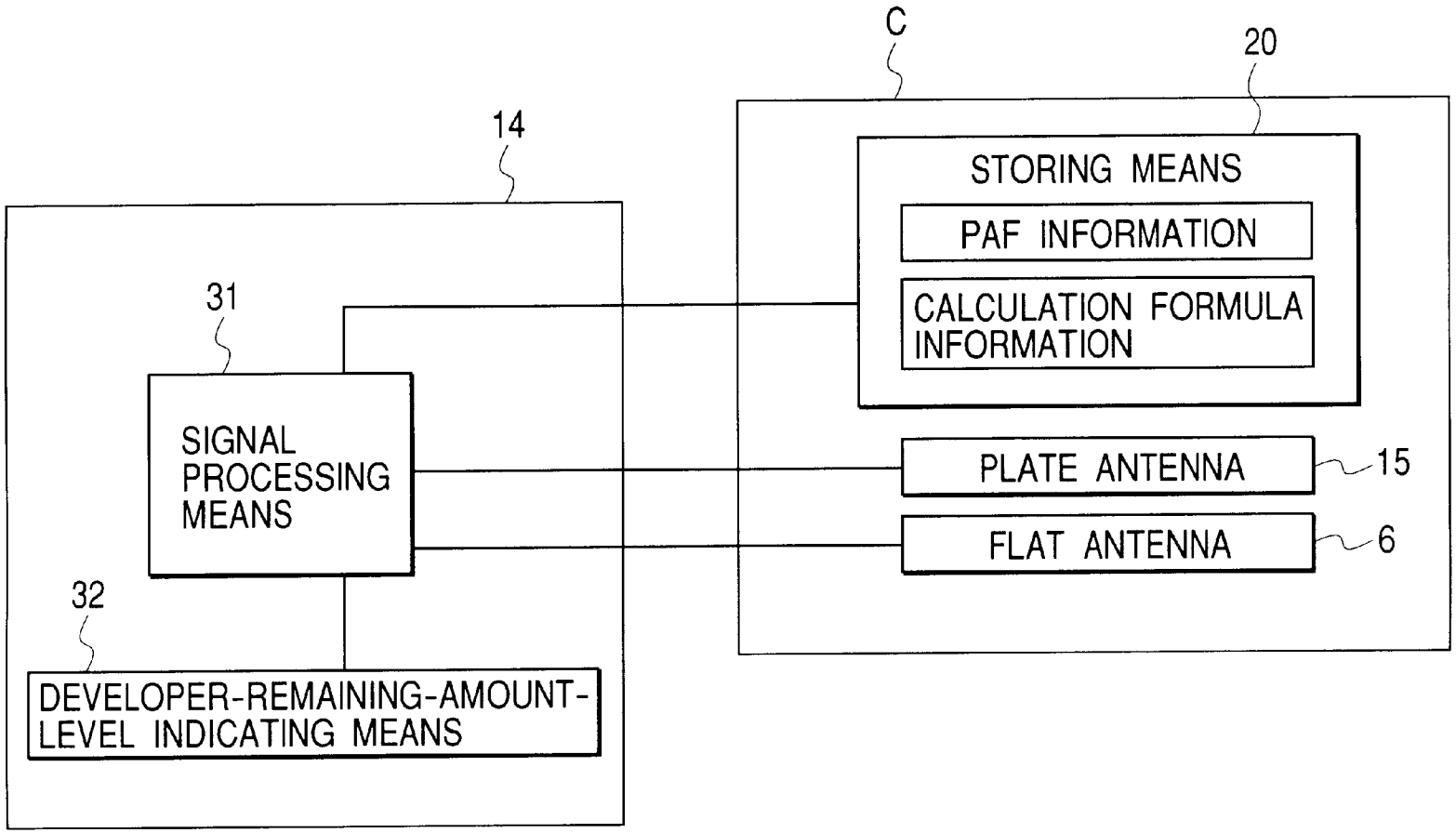
FIG. 10 is a block diagram showing the developer amount detecting construction of the third embodiment.

In FIG. 9, a dot-and-dash line indicates a change in the detected value by the flat antenna (FA), and a solid line indicates a change in the detected value by the plate antenna (PA). Also, PA-(3) and PA-(4) indicate the change when the detected value of PA has been changed in inclination by the disposition of the plate antenna and the tolerance of the cartridge or the main body of the apparatus.

In the first and second embodiments, it is when the output voltage value of the plate antenna 15 has become 2 V that the no-toner warning is given when PAF is 0.8 V. However, when like PA-(3), the inclination has changed so as to become small, the no-toner warning will not be given even if the developer is deficient and the image comes to have a blank area, and this will be the waste of the recording medium such as paper. Also, when like PA-(4), the inclination has changed so as to become great, the no-toner warning will be given in spite of the developer remaining, and this will be the waste of the developer.

So, in the present embodiment, there is provided a construction for giving the accurate no-developer warning even in the situation as described above to thereby prevent the waste of paper and the developer.

As shown in FIG. 9, the measurement ranges of the flat antenna 6 and the plate antenna 15 in the present embodiment are 120 g to 40 g and 50 g or less, respectively, and overlap in the range of 50 g to 40 g.

The developer-remaining-amount measured by the flat antenna 6 and the detected voltage value detected by the plate antenna 15 in the overlapping range are stored in the storing means 20, and from the relation between the developer-remaining-amount and the detected voltage value, a calculation formula in which the detected value by the plate antenna 15 is to be used is calculated, and when at 40 g or less, the developer-remaining-amount is to be measured by the plate antenna 15, the detected value by the plate antenna 15 is used in this calculation formula to thereby indicate the developer-remaining-amount.

Figure 11:
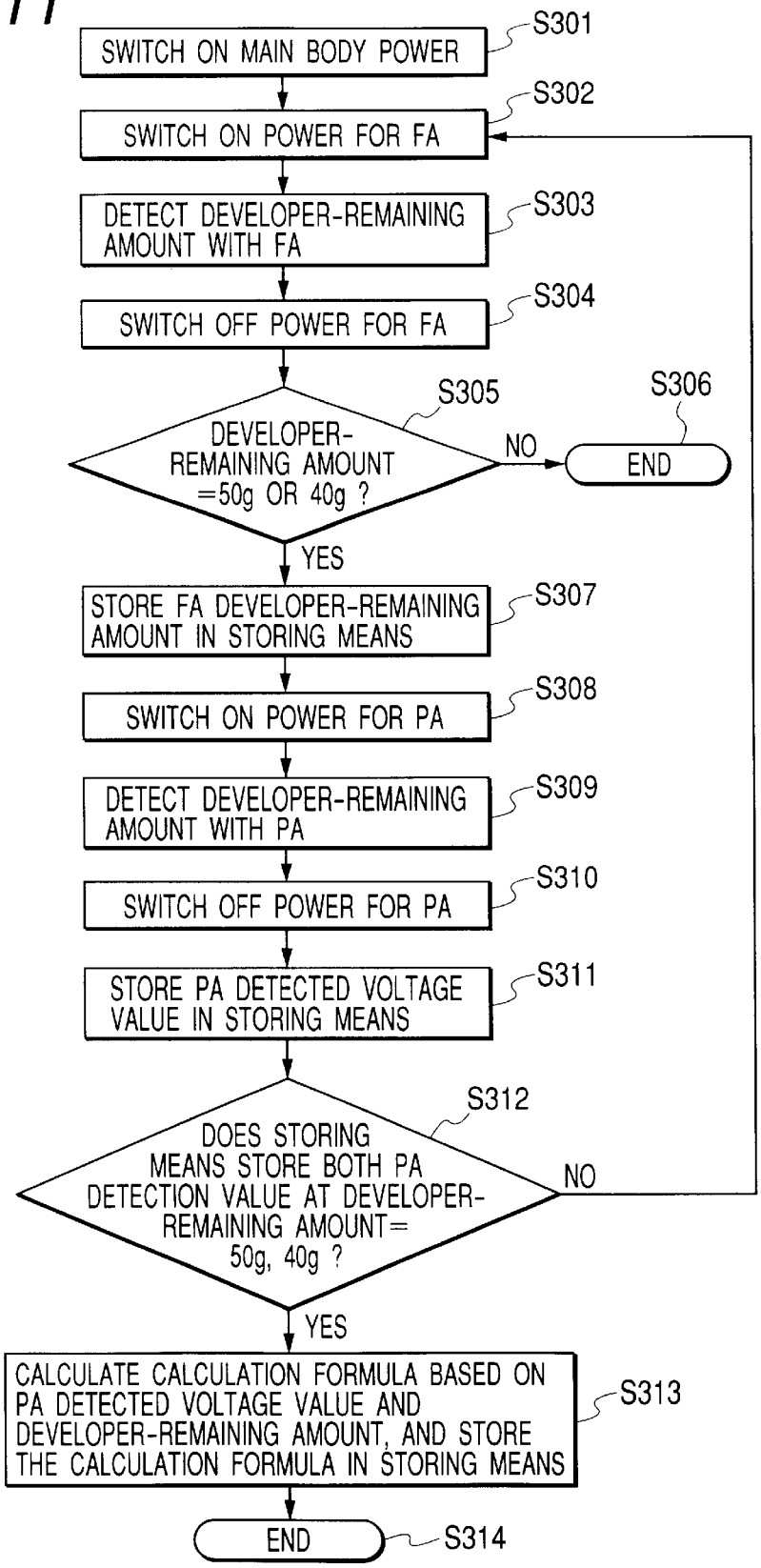
FIG. 11 is a flowchart showing the process of determining a calculation formula for correcting the detection value of the developer-remaining-amount in the third embodiment.

First, a method of determining the above-mentioned calculation formula will be described with reference to the flowchart of FIG. 11. The method of determining PAF is similar to that in the first embodiment.

After the power source of the main body is switched on (S301), the power source for the flat antenna is switched on (S302), and the developer-remaining-amount is detected by the flat antenna 6 (S303), and the power source for the flat antenna is switched off (S304). Then, whether the detected value by the flat antenna 6 is 50 g or 40 g is judged, and if it is other than 50 g or 40 g, the processing is terminated (S306). If the detected value by the flat antenna 6 is 50 g or 40 g, that developer-remaining-amount is stored in the storing means 20 (S307).

Next, the power source for the plate antenna is switched on (S308), and the developer-remaining-amount is detected by the plate antenna 15 (S309), and the power source for the plate antenna is switched off (S310), and the detected voltage value by the plate antenna 15 is stored in the storing means 20 (S311).

Thereafter, whether the detected values of 50 g and 40 g for the developer-remaining-amount by the plate antenna 15 are present in the storing means 20 is judged (S312), and if they are absent, the processing from the step S302 is repeated. If the both values are present in the storing means 20, a calculation formula is derived on the basis of the detected voltage value and the developer-remaining-amount by the plate antenna 15, and it is stored in the storing means 20 (S313), thus terminating the processing (S314). The determination of the above-mentioned calculation formula is done in the following manner.

First, the detected values by the plate antenna 15 when the developer-remaining-amounts measured by the flat antenna 6 are 50 g and 40 g are defined as X1(V) and X2(V), respectively, and the developer-remaining-amount Z(g) when the detected value by the plate antenna 15 is X(V) is $$Z=AX+B \quad (3)$$

where $A=(50-40)/(X1-X2)$ $B=(40\times X1-50\times X2)/(X1-X2)$.

Figure 12:
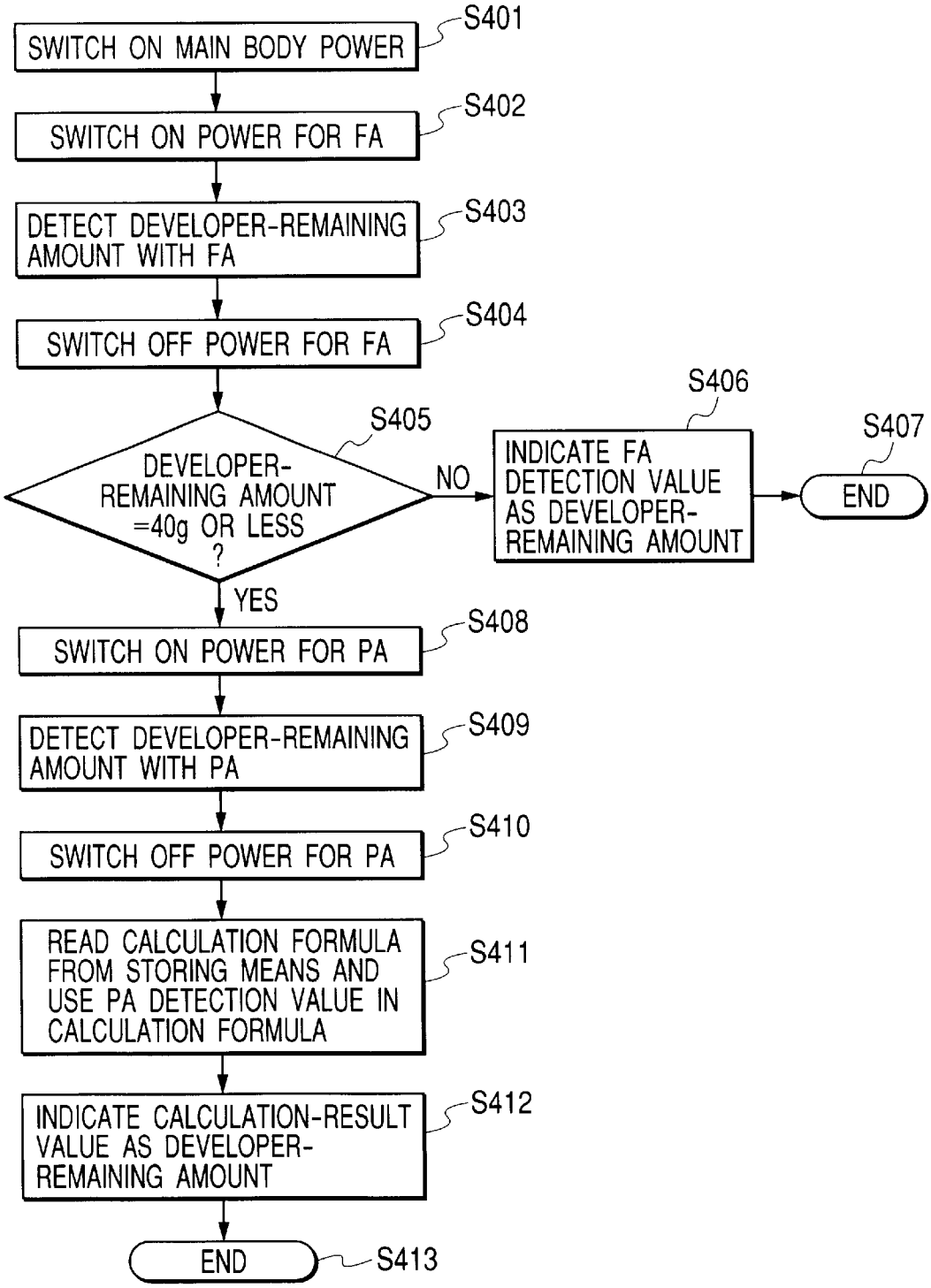
FIG. 12 is a flowchart showing an example of the process of indicating the developer-remaining-amount in the third embodiment.

The developer-remaining-amount indication by the flat antenna (FA) or the plate antenna (PA) will now be described with reference to the flowchart of FIG. 12.

As in the above-described embodiments, the power source of the main body is switched on (S401), and the power source for the flat antenna is switched on (S402). Next, the output of the flat antenna 6 is processed by the signal processing means 31 and the developer-remaining-amount is detected (S403), and the power source for the flat antenna is switched off (S404). Then, whether the detected value by the flat antenna 6 is 40 g or less is judged (S405), and if the developer-remaining-amount is greater than 40 g, the developer-remaining-amount detection value by the flat antenna 6 is indicated as the developer-remaining-amount (S406).

If the detected value by the flat antenna 6 is 40 g or less, the power source for the plate antenna is switched on (S408), and the developer remaining amount is detected (S409), and the power source for the plate antenna is switched off (S410). Then, the calculation formula is read from the storing means 20, and the detected value by the plate antenna 15 is used in the calculation formula (S411), and the value of the result of the detected value having been used in the calculation formula is indicated as the developer-remaining-amount (S412), thus terminating the processing (S413).

As described above, the detected voltage value X(V) successively detected by the plate antenna 15 is used in the above-mentioned expression (3), and the developer-remaining-amount Y(g) is indicated in the developer-remaining-amount-level indicating means 32.

The calculation formula stored in the storing means is, for example, the value of A or B of the above-mentioned expression (3).

Although not shown, the developer-remaining-amount Y(g) calculated on the basis of the above-mentioned expression (3) may be stored in the storing means 20.

In the first embodiment or the second embodiment, correction has been effected when in the relation among the plate antenna 15 and the developer-remaining-amount and the detected voltage value, the inclination is constant and the intercept has changed (FIG. 6), but in the present embodiment, correction can be done even when by the disposition of the plate antenna and the tolerance of the cartridge or the main body of the image forming apparatus, not only the intercept but also the inclination is changed in the relation between the developer remaining amount and the detected voltage value. By this correcting method, it becomes possible to effect more accurate developer-remaining-amount indication.

(Fourth Embodiment)

Figure 13:
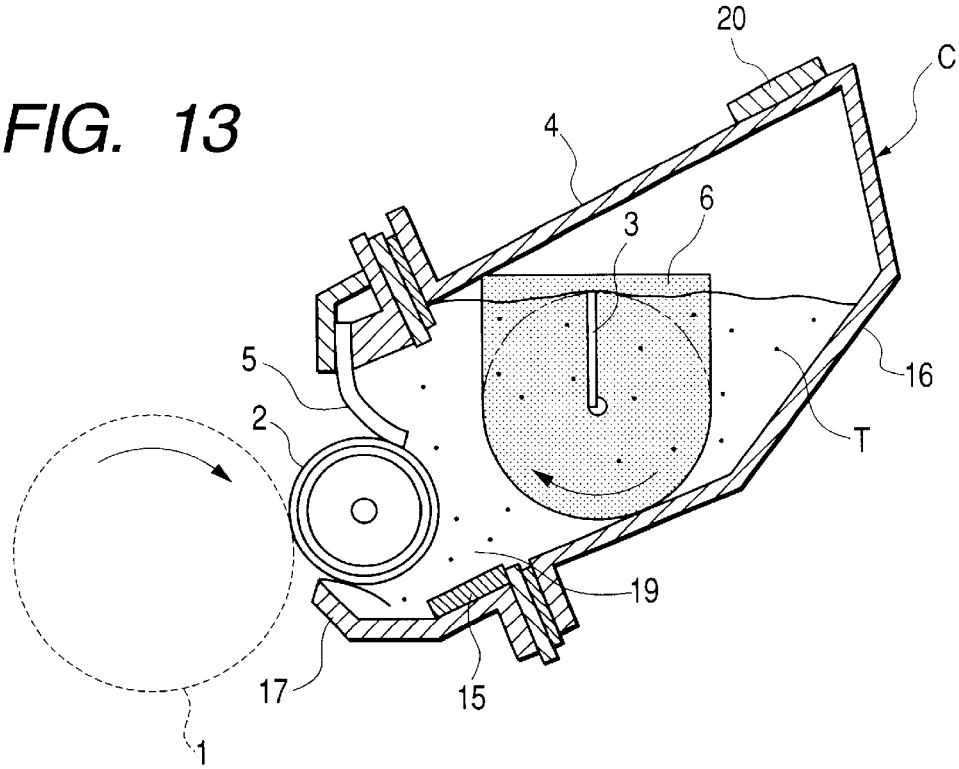
FIG. 13 is a cross-sectional view showing the developing device of a fourth embodiment made into a cartridge.

FIG. 13 shows a developing device C made into a cartridge which is another embodiment of the present invention.

The developing device C of the present embodiment is made into a cartridge by a developing chamber 19 holding developing means such as a developing roller 2 and a developing blade 5 and a developer container 4 containing therein a developer to be supplied to the developing means being constructed integrally with each other by a developer frame 16 and a developing frame 17 made of plastic. That is, the developing device C of the present embodiment is a unit into which the developing device constituting portions of the process cartridge B described in the first embodiment have been made, and can be considered to be a cartridge into which the other means in the process cartridge B than the photosensitive drum 1, the charging means 7 and the cleaning means 8 have been integrally made. Accordingly, all of the developing device constituting portions, the developer amount detecting means construction and the storing means construction described in the first embodiment are also applied to the developing device of the present embodiment. In the present embodiment, the storing means 20 is carried on the developer container 4 side. Accordingly, the foregoing description made in the first, second and third embodiment is invoked for the description of these constructions and the action.

Again in the present embodiment, an operational effect similar to that of the first, second and third embodiments can be achieved.

While in each of the above-described embodiments, the flat antenna system and the plate antenna system are used as the developer amount detecting means, the present invention is not restricted to the developer amount detecting means of these types.

(Fifth Embodiment)

In the fifth embodiment, description will be made of a process cartridge B having a developer (toner) capacity of 1100 g and achieving a large capacity as compared with the process cartridge in the first embodiment.

Figure 14:
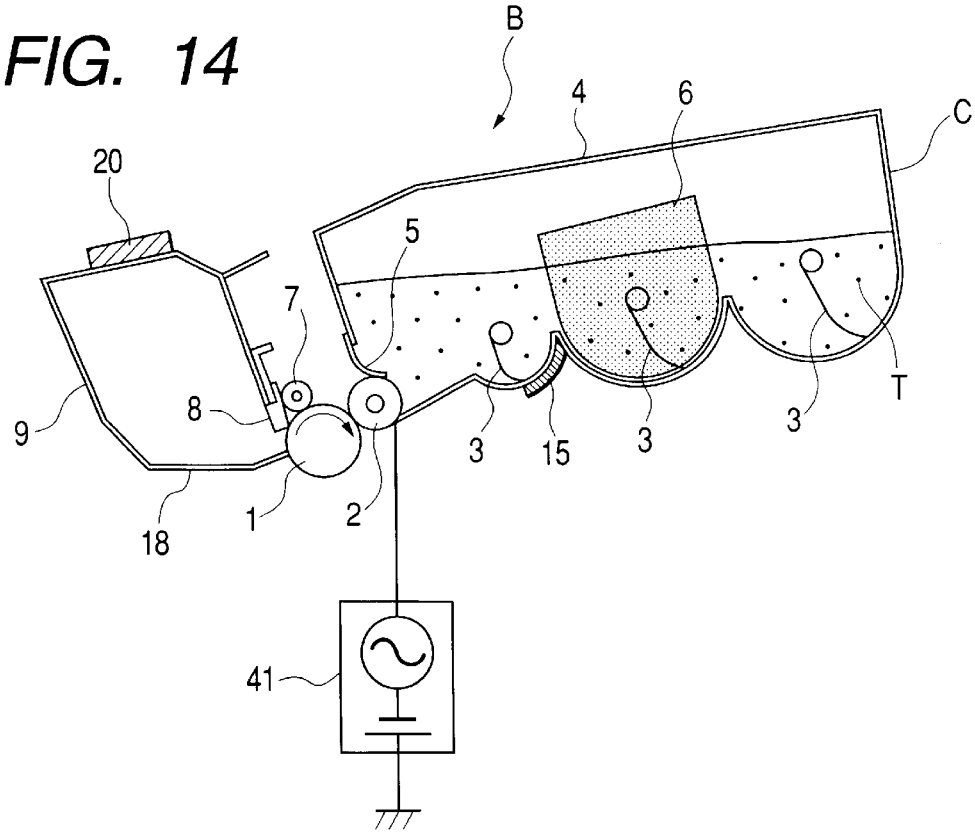
FIG. 14 is a cross-sectional view-showing the process cartridge of a fifth embodiment.

The process cartridge B in the present embodiment is shown in FIG. 14. This process cartridge B is substantially similar in basic construction to the process cartridge of the first embodiment and FIG. 2, but since the developer capacity thereof is 1100 g, it is of a construction in which the larger size of the developing device C itself is achieved and the interior of the developer container 4 is divided into three chambers each provided with agitating means 3 so that the developer T may be used thoroughly. Also, the plate antenna 15 is attached to the outer side of the developing device C. Also, with the larger developer capacity, the developer reservoir 9 is also made larger in size.

Also, the main body itself of the image forming apparatus has no difference in basic construction from the main body of the image forming apparatus of the first embodiment and FIG. 1 and therefore need not be described in the present embodiment.

Figure 15:
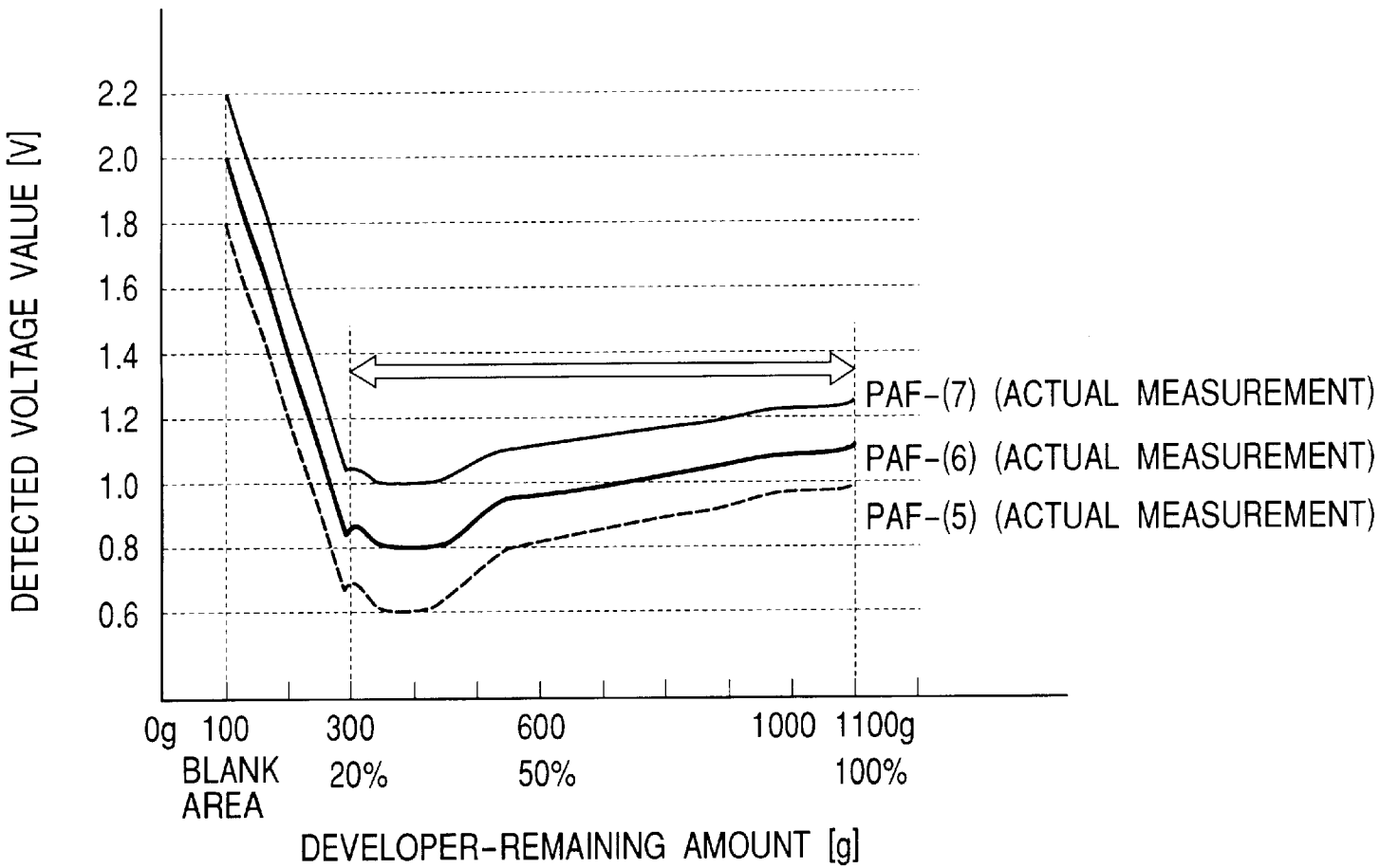
FIG. 15 is a graph showing the relation between the developer-remaining-amount and the detected voltage value of a flat antenna in the fifth embodiment.

In the present embodiment, description will be made of the manner of determining PAF about the change in the detected value by the plate antenna which assumes a minimum value at a certain point as shown in FIG. 15, and the developer-remaining-amount indication based on the PAF.

Figure 16:
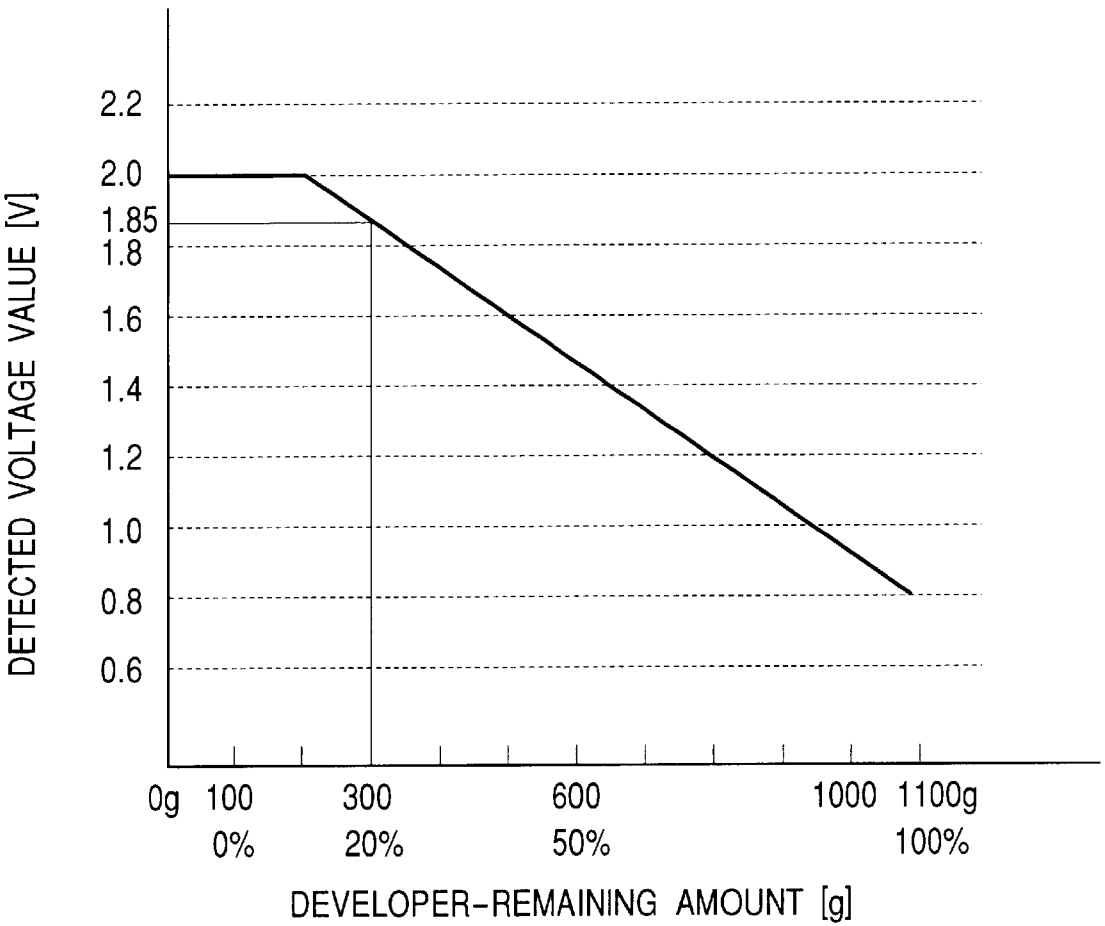
FIG. 16 is a graph showing the relation between the developer-remaining-amount and the detected voltage value of a plate antenna in the fifth embodiment.

In the fifth embodiment, the detection area of the plate antenna 15 is 300 g or less (FIG. 15), and the detection area of the flat antenna 6 is between 1100 g to 200 g (FIG. 16). However, the detected voltage value by the plate antenna 15 when the developer-remaining-amount is 300 g is not in a proportional relation with the detected voltage value when the developer-remaining-amount is 100 g, that is, when the image has a blank area, but the minimum value of the detected voltage value by the plate antenna is in a proportional relation with the detected voltage value when the image has a blank area, and below the vicinity of 300 g, there is linearity in the developer-remaining-amount and the detected voltage value by the plate antenna 15. This is considered to be because the developer-remaining-amount between the plate antenna 15 and the developing roller 2 at a point of time whereat the developer-remaining-amount is 300 g reaches a maximum amount and is in an unstable state. In such a case, when the detected voltage value by the plate antenna 15 at the point of time whereat the developer-remaining-amount is 300 g is set as PAF, there is a case where the developer-remaining-amount indication immediately before a developer blank area cannot be done precisely by the detecting method using the plate antenna 15 of the first embodiment. However, it has been found that according to PAF-(5), PAF-(6) and PAF-(7), the minimum value of the detected voltage value by the plate antenna 15 is in a proportional relation with the detected voltage value before the developer blank area.

So, in the present embodiment, the minimum value of the detected voltage value by the plate antenna 15 continues to be renewed as PAF until the detected value of the developer-remaining-amount by the flat antenna 6 becomes 20%, and the minimum value when the detected value of the developer-remaining-amount by the flat antenna 6 has become 20% is decided upon as PAF, whereafter the renewal of PAF is not done. Then, the developer-remaining-amount is measured by the plate antenna 15, and the developer-remaining-amount is calculated on the basis of the PAF value, and the accurate detection of the developer-remaining-amount when the developer-remaining-amount is small is made possible.

Figure 17:
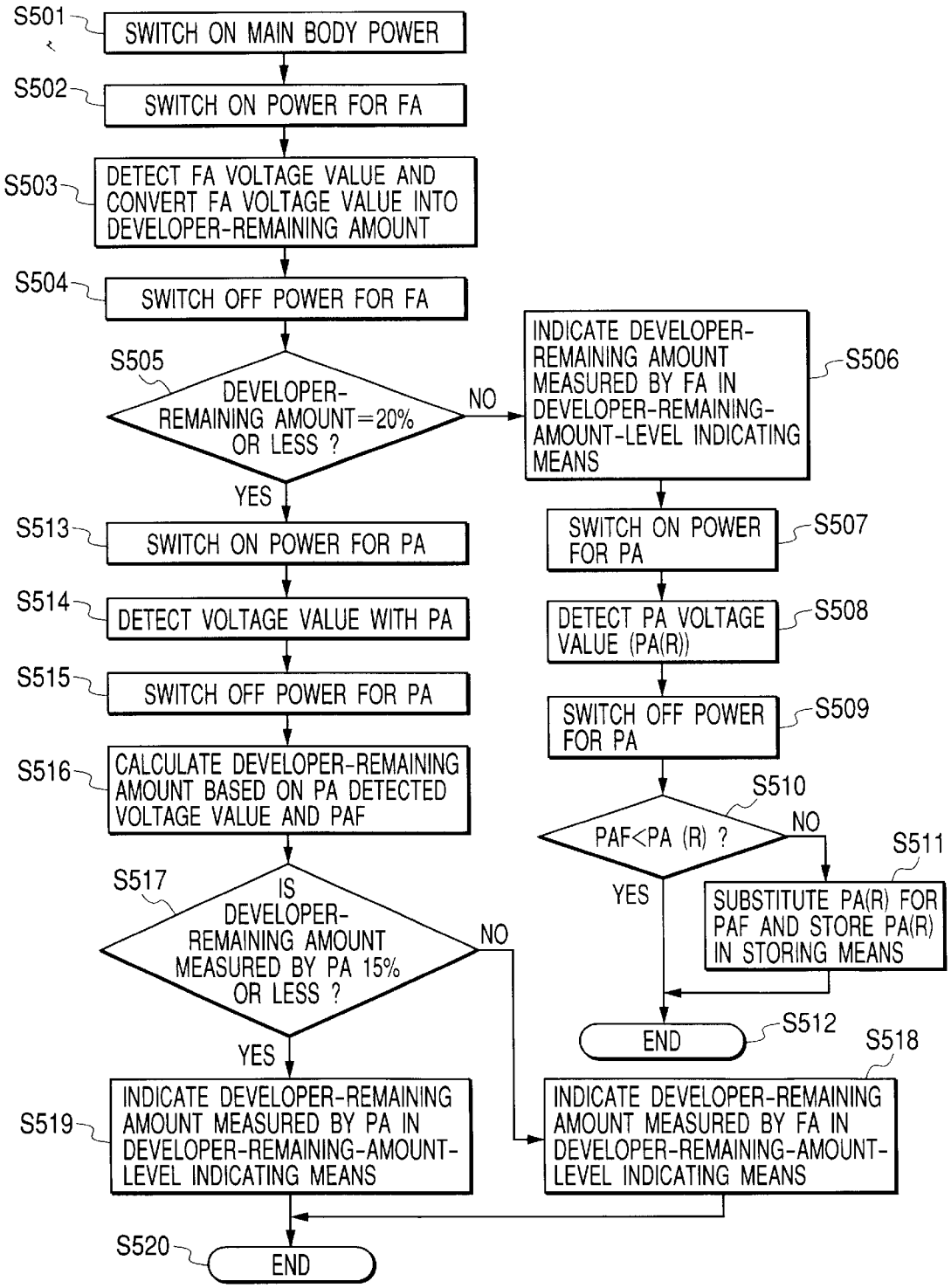
FIG. 17 is a flowchart showing the developer-remaining-amount detecting process of the fifth embodiment.

So, the sequence of the PAF determination and the developer-remaining-amount-level indication is shown in the flowchart of FIG. 17.

At a step S501, the power source of the main body is switched on, whereafter the power source for the flat antenna 6 is switched on (S502), and the voltage value of the flat antenna 6 is detected and is converted into a developer-remaining-amount by the signal processing means 31 (S503). Thereafter, the power source for the flat antenna 6 is switched off (S504), and whether the developer-remaining-amount is 20% or less is judged by the signal processing means 31 (S505), and if it is judged that the developer-remaining-amount is not 20% or less, the developer-remaining-amount measured by the flat antenna 6 is indicated in the developer-remaining-amount-level indicating means 32 (S506), and the power source for the plate antenna 15 is switched on (S507). Thereafter, the voltage value (PA(R)) of the plate antenna 15 is detected (S508), and the power source for the plate antenna 15 is switched off (S509), and whether PAF is greater than PA(R) is judged by the signal processing means 31 (S510), and if PAF is greater, PA(R) is stored as PAF in the storing means 20 (S511), thus terminating the processing (S512). If PAF is smaller, the processing is intactly terminated (S512).

On the other hand, if the developer-remaining-amount measured by the flat antenna 6 is 20% or less (S505), the power source for the plate antenna 15 is switched on (S513), and the voltage value of the plate antenna 15 is detected (S514), and the power source for the plate antenna 15 is switched off (S515). Thereafter, the developer-remaining-amount is calculated by the signal processing means 31 on the basis of the detected voltage value of the plate antenna 15 and PAF (S516), and whether the developer-remaining-amount measured by the plate antenna 15 is 15% or less is judged (S517). If as the result of the judgment, the developer-remaining-amount measured by the plate antenna 15 is greater than 15%, the developer-remaining-amount measured by the flat antenna 6 is indicated in the developer-remaining-amount-level indicating means 32 (S518), thus terminating the processing (S520). Also, if as the result of the judgment, the developer-remaining-amount measured by the plate antenna 15 is 15% or less, the developer-remaining-amount measured by the plate antenna 15 is indicated in the developer-remaining-amount-level indicating means 32 (S519), thus terminating the processing (S520).

The method of calculating the developer-remaining-amount by the use of the detected voltage value by the plate antenna 15 and PAF at the step S516 is basically similar to that in the first embodiment, but in the present embodiment, the change in the vicinity of 300 g is particularly unstable and the change in the developer-remaining-amount from a little less than 300 g to 100 g is linear and therefore, the developer-remaining-amount of a little less than 300 g to 100 g is calculated with the minimum renewed value of the plate antenna 15, i.e., PAF, as the detected voltage value for 300 g (20%).

Accordingly, the developer-remaining-amount rate P(%) when the detected value is X(V) is $$P=-(50/3)X+100/3 \quad (4)$$

Again in the present embodiment, an operational effect similar to that of the first, second and third embodiments can be achieved.

While in each of the above-described embodiments, the flat antenna system and the plate antenna system are used as the developer amount detecting means, the present invention is not restricted to the developer amount detecting means of these types.

The above-mentioned calculated developer-remaining-amount and developer-remaining-amount rate P may be stored in the storing means 20.

The developing device C in the process cartridge B of the embodiment described above with reference to FIG. 14, like the fourth embodiment, can be embodied as a developing device C made into a cartridge, and again in this case, an operational effect similar to that of the fourth embodiment can be achieved.

That is, the developing device C in this case is made into a cartridge by the developing chamber 19 holding the developing means such as the developing roller 2 and the developing blade 5 and the developer container 4 containing therein the developer to be supplied to the developing means being constructed integrally with each other by the developer frame 16 and developing frame 17 made of plastic. That is, the developing device C according to the present embodiment is a unit into which the developing device constituting portions of the process cartridge B described with reference to FIG. 14 have been made, and can be considered to be a cartridge into which the other means in the process cartridge B than the photosensitive drum 1, the charging means 7 and the cleaning means 8 have been integrally made. Accordingly, all of the developing device constituting portions, the developer amount detecting means construction and the storing means construction described in the first embodiment are also applied to the developing device of the present embodiment. In this case, the storing means 20 is carried on the developer container 4 side.

What is claimed is:

1. A cartridge detachably mountable to a main body of an image forming apparatus, said cartridge comprising:

a developer container;

first detecting means for detecting a developer-remaining amount within a first range in said developer container;

second detecting means for detecting a developer-remaining amount within a second range in said developer container; and storing means for storing information regarding an amount of developer, said storing means having a storage area for storing information regarding the developer-remaining amount detected by said second detecting means when the developer-remaining amount detected by said first detecting means is within a predetermined range.

2. A cartridge according to claim 1, wherein the image forming apparatus includes a signal processing device for calculation processing the information regarding the developer-remaining amount, and said storing means has a storage area for storing a value obtained by a plurality of the information regarding the developer-remaining amount detected by said second detecting means being calculation processed by the signal processing device when the developer-remaining amount detected by said first detecting means is within the predetermined range.

3. A cartridge according to claim 1, wherein the image forming apparatus includes a signal processing device for calculation processing the information regarding the developer-remaining amount to correction process the information, and said storing means has a storage area for storing a value obtained by the information regarding the developer-remaining amount detected by said second detecting means being correction processed by the signal processing device using the stored information.

4. A cartridge according to claim 1, wherein the image forming apparatus includes a signal processing device for calculation processing the information regarding the developer-remaining amount, and said storing means has a storage area for storing calculation formula information obtained by the information regarding the developer-remaining amount detected by said second detecting means being calculation processed by the signal processing device when the developer-remaining amount detected by said first detecting means is equal to a predetermined value.

5. A cartridge according to claim 1, wherein the image forming apparatus includes a signal processing device for calculation processing the information regarding the developer-remaining amount, and said storing means has a storage area for updating and storing information regarding the developer-remaining amount detected by repeating a detection operation of said second detecting means until the developer-remaining amount detected by said first detecting means reaches a predetermined value.

6. A cartridge according to claim 1, wherein said first detecting means has a flat antenna, and said second detecting means has a plate antenna.

7. A cartridge according to claim 1, wherein said storing means is a nonvolatile memory.

8. A cartridge according to claim 1, further comprising at least one of an electrophotographic photosensitive member, charging means for charging said electrophotographic photosensitive member, developing means for supplying the developer to said electrophotographic photosensitive member, and cleaning means for cleaning said electrophotographic photosensitive member.

9. An image forming apparatus to which a cartridge is detachably mountable, the cartridge comprising a developer container, first detecting means for detecting a developer-remaining amount within a first range in the developer container, second detecting means for detecting a developer-remaining amount within a second range in the developer container, and storing means for storing information regarding an amount of developer, said image forming apparatus comprising:

a signal processing device for calculation processing information regarding the developer-remaining amount, wherein said signal processing device causes the storing means to store information regarding the developer-remaining amount detected by the second detecting means when the developer-remaining amount detected by the first detecting means is within a predetermined range, and corrects the developer-remaining amount detected by the second detecting means using the stored information.

10. An image forming apparatus according to claim 9, wherein when the developer-remaining amount detected by the first detecting means is equal to a predetermined value, said signal processing device causes the storing means to store calculation formula information calculated by using the information regarding the developer-remaining amount detected by the second detecting means, and corrects the developer-remaining amount detected by the second detecting means using the stored calculation formula information.

11. An image forming apparatus according to claim 9, wherein when the developer-remaining amount detected by the first detecting means is within the predetermined range, said signal processing device causes the storing means to store a value obtained by calculation processing information regarding a plurality of developer-remaining amounts detected by the second detecting means, and corrects the developer-remaining amounts detected by the second detecting means using the stored information.

12. An image forming apparatus according to claim 9, wherein said signal processing device causes the second detecting means to detect repeatedly the developer-remaining amount until the developer-remaining amount detected by the first detecting means reaches a predetermined value, causes the storing means to update and store information regarding the detected developer-remaining amount, and corrects the developer-remaining amount detected by the second detecting means using the stored information.

13. An image forming apparatus according to claim 9, further comprising indicating means for performing an indicating operation, and wherein said signal processing device transmits a calculated developer-remaining amount to said indicating means or an external indicating instrument.

14. An image forming apparatus according to claim 9, wherein the first detecting means has a flat antenna, and the second detecting means has a plate antenna.

15. An image forming apparatus according to claim 9, wherein the storing means is a nonvolatile memory.

16. An image forming apparatus according to claim 9, further comprising at least one of an electrophotographic photosensitive member, charging means for charging said electrophotographic photosensitive member, developing means for supplying the developer to said electrophotographic photosensitive member, and cleaning means for cleaning said electrophotographic photosensitive member.

17. A method of controlling an image forming apparatus to which a cartridge is detachably mountable, the cartridge comprising a developer container, first detecting means for detecting a developer-remaining amount within a first range in the developer container, second detecting means for detecting a developer-remaining amount within a second range in the developer container, and storing means for storing information regarding an amount of developer, wherein the image forming apparatus comprises signal processing means for calculation processing information regarding the developer-remaining amount, said method comprising the steps of:

detecting the developer-remaining amount in the developer container by said first detecting means;

determining whether the developer-remaining amount detected in said detecting step is within a predetermined range;

storing in the storing means information regarding the developer-remaining amount in the developer container detected by the second detecting means when it is determined that the developer-remaining amount is within the predetermined range in said determining step; and correcting the developer-remaining amount detected by the second detecting means using the stored information.

18. A method according to claim 17, further comprising the step of storing in the storing means a value obtained by calculation processing information regarding a plurality of the developer-remaining amounts detected by the second detecting means when it is determined that the developer-remaining amount detected in said detecting step is within the predetermined range in said determining step.

19. A method according to claim 17, further comprising the steps of:

storing in the storing means calculation formula information calculated by the signal processing means using information regarding the developer-remaining amount detected by the second detecting means when the developer-remaining amount detected by the first detecting means is equal to a predetermined value; and correcting the developer-remaining amount detected by the second detecting means using the calculation formula information.

20. A method according to claim 17, further comprising the steps of:

detecting repeatedly the developer-remaining amount by the second detecting means until the developer-remaining amount detected by the first detecting means reaches a predetermined value; and updating and storing in the storing means information regarding the developer-remaining amount detected in said detecting step.

21. A method according to claim 17, further comprising the step of transmitting the developer-remaining amount corrected in said correcting step to indicating means for performing an indicating operation in the image forming apparatus or to external indicating means for performing an indicating operation.

22. A cartridge detachably mountable to a main body of an image forming apparatus, said cartridge comprising:

a developer container;

a first detector arranged to detect a developer-remaining amount within a first range in said developer container;

a second detector arranged to detect a developer-remaining amount within a second range in said developer container; and a memory adapted to stored information regarding an amount of developer, said memory having a storage area for storing information regarding the developer-remaining amount detected by said second detector when the developer-remaining amount detected by said first detector is within a predetermined range.

23. A cartridge according to claim 22, wherein the image forming apparatus includes a signal processor adapted to calculate the information regarding the developer-remaining amount, and said memory has a storage area for storing a value obtained by the information regarding the developer-remaining amount detected by said second detector being calculation processed by the signal processor using the stored information.

24. A cartridge according to claim 22, wherein the image forming apparatus includes a signal processor adapted to calculate the information regarding the developer-remaining amount, and said memory has a storage area for updating and storing information regarding the developer-remaining amount detected by repeating a detection operation of said second detector until the developer-remaining amount detected by said first detector reaches a predetermined value.

25. An image forming apparatus to which a cartridge is detachably mountable, the cartridge comprising a developer container, a first detector arranged to detect a developer-remaining amount within a first range in the developer container, a second detector arranged to detect a developer-remaining amount within a second range in the developer container, and a memory adapted to store information regarding an amount of developer, said image forming apparatus comprising:

a signal processor adapted to calculate information regarding the developer-remaining amount, wherein said signal processor causes the memory to store information regarding the developer-remaining amount detected by the second detector when the developer-remaining amount detected by the first detector is within a predetermined range, and corrects the developer-remaining amount detected by the second detector using the stored information.

26. An image forming apparatus according to claim 25, wherein said signal processor causes the second detector to detect repeatedly the developer-remaining amount until the developer-remaining amount detected by the first detector reaches a predetermined value, causes the memory to update and store information regarding the detected developer-remaining amount, and corrects the developer-remaining amount detected by the second detector using the stored information.

27. A memory device to be mounted on a cartridge of an image forming apparatus, the cartridge being usable with a main body of the image forming apparatus, the cartridge including a developer container, first detecting means for detecting a developer-remaining amount within a first range in the developer container, and second detecting means for detecting a developer-remaining amount within a second range in the developer container, said memory device comprising:

a first memory portion for storing information regarding an amount of developer comprising the developer-remaining amount detected by the second detecting means when the developer-remaining amount detected by the first detecting means is within a predetermined range.

28. A memory device according to claim 27, wherein the image forming apparatus includes signal processing means for performing correction processing to correct the developer-remaining amount, and said memory device further comprises a second memory portion for storing a value obtained by the signal processing means correction processing the developer-remaining amount detected by the second detecting means using information regarding the amount of developer stored in said first memory portion.

29. A memory device according to claim 27, wherein the cartridge of the image forming apparatus includes a photosensitive drum, charging means for charging the photosensitive drum, and developing means for supplying developer to the photosensitive drum.

30. A control system for controlling an image forming apparatus comprising a main body and a process cartridge, the cartridge including a developer container, first detecting means for detecting a developer-remaining amount within a first range in the developer container, and second detecting means for detecting a developer-remaining amount within a second range in the developer container, said control system comprising:

a memory device mounted on the cartridge and including a first memory portion for storing information regarding an amount of developer comprising the developer-remaining amount detected by the second detecting means when the developer-remaining amount detected by the first detecting means is within a predetermined range; and signal processing means for causing said memory device to store the information regarding the developer-remaining amount detected by the second detecting means when the developer-remaining amount detected by the first detecting means is within the predetermined range, and correcting the developer-remaining amount detected by the second detecting means using the stored information.

31. A control system according to claim 30, wherein said signal processing means performs correction processing, wherein said memory device further includes a second memory portion for storing a value obtained by said signal processing means correction processing the developer-remaining amount detected by the second detecting means using information regarding the amount of developer stored in said first memory portion.

32. A control system according to claim 30, wherein the cartridge of image forming apparatus includes a photosensitive drum, charging means for charging the photosensitive drum, and developing means for supplying developer to the photosensitive drum.

* * * * *

UNITED STATES PATENT AND TRADEMARK OFFICE

CERTIFICATE OF CORRECTION

PATENT NO. : 6,615,001 B2
DATED : September 2, 2003
INVENTOR(S) : Yasunao Otomo et al.

It is certified that error appears in the above-identified patent and that said Letters Patent is hereby corrected as shown below:

Column 3,
Lines 58 and 64, “the full of the” should read -- is at full --.

Column 4,
Line 15, “eliminated, a” should read -- eliminated and to provide a --.

Column 8,
Line 66, “an” should read -- a --.

Column 20,
Line 44, “nonvolatile” should read -- non-volatile --.

Column 21,
Line 42, “nonvolatile” should read -- non-volatile --.

Signed and Sealed this

Thirtieth Day of March, 2004

JON W. DUDAS
*Acting Director of the United States Patent and Trademark Office*